US005954157A

United States Patent [19]

Grimes et al.

[11] Patent Number: 5,954,157

[45] Date of Patent: Sep. 21, 1999

[54] FIBER/RESIN COMPOSITE LADDER AND ACCOMPANYING ACCESSORIES

[75] Inventors: Ronald R. Grimes; Jefferson B. Hunt, both of Provo, Utah

[73] Assignee: Fiberlite Technologies, Inc., Salt Lake City, Utah

[21] Appl. No.: 08/990,101

[22] Filed: Dec. 12, 1997

Related U.S. Application Data

[63] Continuation-in-part of application No. 08/810,031, Mar. 4, 1997, which is a continuation of application No. 08/326,012, Oct. 18, 1994, abandoned.

[51] Int. Cl.[6] ..... E05D 11/00; E06C 7/50

[52] U.S. Cl. ..... 182/163; 16/329

[58] Field of Search ..... 182/162, 165; 403/96, 93; 16/324, 325, 329

[56] References Cited

U.S. PATENT DOCUMENTS

| | | | |
|---|---|---|---|
| 3,517,965 | 6/1970 | Cowles . | |
| 4,087,885 | 5/1978 | Gillentine . | |
| 4,447,033 | 5/1984 | Jaumann . | |
| 4,474,264 | 10/1984 | Krause | 182/163 |
| 4,697,305 | 10/1987 | Boothe | 182/163 |

*Primary Examiner*—Alvin Chin-Shue
*Attorney, Agent, or Firm*—Kirton & McConkie

[57] ABSTRACT

A combination step and extension ladder manufactured of prestressed filament wound composite material such as fiberglass is disclosed. The inner and outer side rails are molded, filament wound composite material (fiberglass) wherein the fibers are continuous and angularly oriented with respect to the longitudinal axis of the respective side rails. Hinges are provided on each of the inner side rails of the ladder and hinge actuators are located in the front edges of the outer side rails so that the ladder may be folded, unfolded or locked in either a closed, step ladder or straight extension ladder configuration, by depressing the hinge actuators, irrespective of the longitudinal position of the inner rail sections with respect to the outer rail sections. The inner side rails are telescopically mounted within channeled portions of the outer rails and interfaced with an "interlocking tongue and groove joint" such that the inner side rails can be extended to increase the height of the ladder in either configuration without compromising the torsion characteristics of the outer rail under a weighted load. Both the inner and outer side rails have composite rungs, integrally molded into the sides to produce a homogeneous casting. Ladder accessories are provided that facilitate stability and convenient use during operation thereof.

7 Claims, 31 Drawing Sheets

FIBER/RESIN COMPOSITE LADDER AND ACCOMPANYING ACCESSORIES

RELATED APPLICATIONS

This is a continuation-in-part application of co-pending application U.S. Ser. No. 08/810,031, filed Mar. 4, 1997, entitled "Prestressed Fiber/Resin Composite Ladder & Methods for Manufacturing Same" which is a continuation application of U.S. Ser. No. 08/326,012, filed Oct. 18, 1994, now abandoned.

BACKGROUND OF THE INVENTION

THE FIELD OF THE INVENTION

The present invention relates generally to fiberglass ladders. More specifically the present invention relates to an improved fiberglass ladder having accompanying accessories that facilitate useful and convenient operation thereof.

THE RELEVANT TECHNOLOGY

Ladders are commonly used for a variety of applications and are of two general types; (1) a folding ladder, commonly called a stepladder, which is self-supporting, and (2) a straight extension ladder. Stepladders are typically used where it may be impossible to lean the ladder against a structure for support. On the other hand, an extension ladder may be leaned against a wall or some other structure when in use. Such ladders often include an extensible segment which can be used to telescopically extend the length of the ladder as desired.

Ladders which are constructed so that they may be used both as stepladders and as straight extension ladders are well-known in the art. Typically, such ladders are constructed with hinges in the middle of the side rails. The hinges permit the ladder to be folded into a stepladder configuration or unfolded into a straight extension ladder configuration. As will be readily appreciated, combination step and extension ladders are very versatile and combine the desirable features of both types of ladders.

The combination step and extension ladders of the past are typically made of aluminum or steel. Because metal ladders are electrically conductive, the regulations of the Occupational Safety and Health Administration (OSHA) state that such ladders should not be used near live electrical wiring.

For this and other reasons, lighter weight fiberglass ladders have been introduced. Non-electrically conductive materials used in fiberglass ladders typically include various fiber/resin composites. A "fiber/resin composite" is a material composed of glass fibers bonded in a resin matrix. Such composites are sometimes referred to (albeit imprecisely) by the generic term "fiberglass." Fiberglass has been found to be an excellent material for the making of ladders, not only because of the non-electrically conductive property of fiberglass composites but also because of the excellent energy absorbing characteristics of the material (as illustrated by its use in helicopter rotors and pole vault poles).

Unfortunately, fiberglass is an isentropic material, that is, its properties depend to a significant extent upon the orientation of the fibers within the composite material. The fiber orientation effects such properties as the transverse, bearing, tensile, compression and flexural strengths of the resultant fiberglass material as well as its rigidity or stiffness.

While ladders made of composite materials are known in the art, such ladders have generally been made through a process known as "pultrusion." In general terms, the pultrusion process includes coating the fibers with a resinous material and then pulling the fibers through a heated die where the resin hardens into the desired shape. Microwave energy is often used to heat the resin to its curing temperature.

The pultrusion method results in the fibers being unidirectionally oriented within the resinous material. Although material fabricated by the pultrusion method has excellent longitudinal strength, such a material also has relatively low flexural, transverse, and bearing strengths.

In an attempt to overcome, to a limited extent, the problems encountered in making a ladder from unidirectionally oriented fiberglass, some ladders utilize a substantially increased thickness of material at stress points or have combined a non-oriented fabric with the resinous coated fibers in order to impart sufficient strength to the fiberglass at stress points. However, such techniques, particularly increasing the thickness of the fiberglass, have resulted in a ladder which is much heavier and more cumbersome to use. Such a ladder is also more expensive to construct.

In an attempt to take advantage of fibers aligned in their optimum angular orientation, strips of cloth with properly oriented fibers have been wrapped around a foam mandrel and compressed in a mold during the curing process. See, e.g., U.S. Pat. Nos. 4,371,055 and 4,376,470. This method, although an improvement upon the prior art, leaves the fibers in a compressed or "bunched" state and offers only a slight improvement in the transverse and flexural strength of the resultant material. The bearing, tensile and compression strengths remain unchanged. Again, additional material must be employed to achieve minimal strength.

Likewise, continuous filament winding has been utilized to increase the strength of the ladder by optimizing the transfer of stresses along the filament. While this technique does improve the strength of the ladder, the benefits are only imparted to the areas which are not later punctured or otherwise pierced causing interrupted fibers. Such areas often include the intersection of the rungs with the side rails, an area usually requiring extra strength.

As will be appreciated, the problems encountered by the prior art with respect to a fiberglass ladder are greatly exaggerated when the ladder is extensible, such as in a combination step and extension ladder. In such ladders, both inner and outer side rails are formed such that the inner side rails can be telescopically moved and extended within the outer side rails and, once the desired position is achieved, can be locked into position.

With fiberglass side rails, the ladder rungs cannot be simply welded to the edges of the side rails. Two general methods have, therefore, been developed to attach rungs to the side rails of fiberglass ladders. One way is to employ formable material in the rungs, typically aluminum, which is so fabricated as to allow a portion of the rung to pass through holes cut in the sides of the rails. The protruding end of the rung is then expanded to a larger surface than the size of the hole in the rails. This method requires holes to be cut in the side rails. These holes have a tendency to compromise the integrity of the fiberglass structure. To compensate for this loss, the side walls of the rail must be thickened considerably which raises both the weight and the cost of the end product.

To avoid these problems, a second method of attaching rungs to a fiberglass side rail has been developed. This method utilizes a bonding agent to glue or otherwise bond the rungs into place. Typically, aluminum rungs are so bonded into fiberglass side rails. See, e.g., U.S. Pat. Nos. 4,371,055 and 4,376,070. As the coefficient of thermal expansion varies greatly between aluminum and fiberglass, the bonding agent must be flexible enough to compensate for the difference and therefore cannot be as rigid or strong as either of the components being bonded. Extreme variation in temperature can result in disbonding and the integrity of the ladder may be compromised.

The telescopic characteristic of most extensible ladders is accomplished by passing a rectangular inner side rail through a channeled or "C" shaped outer rail. When a load or weight is exerted upon the ladder, that portion of the load vector that is generated perpendicular to the assembly tends to cause the channel to expand and twist. This torsion and expansion tendency is particularly concentrated on ladders constructed with a flared bottom section. These ladders gain stability by flaring the outer rails outwardly and away from the inner rails.

One disadvantage of flaring the outer rails outwardly away from the inner rails is that the area of intersection between the rails is reduced. Because of the reduced intersection between the inner and outer rails, the tendency towards expansion and torsion are greatly multiplied. This tendency increases as the angle or inclination of the ladder is decreased and the perpendicular load vector increases. In this flared construction, if the outer rail section expands enough to allow the inner rails to escape or dislodge from the union, the integrity of the assembly is compromised and the ladder will collapse. In the prior art an attempt to overcome this tendency has been made by "beefing up" the fabric included in the channeled area by adding significantly more material to the channeled section.

In the typical prior art, the ability to change the configuration of the ladder from a step ladder to an extension ladder is accomplished by utilizing a multi-positioned hinge at the center of each side rail. Ladders of this type typically rely upon the application of some force (pushing or pulling) upon a hinge actuator located at the hinge itself. (See, e.g., U.S. Pat. No. 4,666,328.) When such a ladder is extended while in its step ladder configuration, the hinge and its actuator mechanism become out of reach of the user. When converting the configuration to that of an extension ladder it becomes necessary to either lay the step ladder on its side to reach the actuators or to collapse the step ladder to bring the actuators into reach.

With all ladders, and other user lifting arrangements such as scaffolding, safety for the user is one of the primary concerns during manufacturing. Yet safety concerns surprisingly do not translate into ladder features and improvements that are directed towards the actual surfaces against which the ladder is leaned during operational use. Those surfaces, many of which not only promote instability but hinder safety, include corners of buildings, apses, trees and poles. Additionally, many other surfaces hinder safe utilization of the ladder from beneath the ladder such as grass (rain soaked, dewy or dry) and ice. Moreover, many surfaces against which the ladder is operationally positioned are fragile, expensive or both and are not well suited for receiving a ladder. Some of which can even be irreparably damaged if a ladder is positioned there against. These surfaces include walls and floors made up of marble, tiles, precious metals, like gold and silver, paintings and ceramics. Accordingly, it is desirous to provide safety features adaptive to the foregoing surfaces.

SUMMARY AND OBJECTS OF THE INVENTION

It is, therefore, an object of the present invention to provide a lightweight, composite ladder which can be used in the presence of electricity.

It is another object of the present invention to provide a ladder which has a multi-position hinge that is remotely actuated.

It is another object of the present invention to provide a method of manufacture which allows the fibers within the ladder to be oriented and operated upon to provide more strength to the ladder.

It is yet another object of the present invention to provide a composite ladder which can function both as a step ladder or as an extension ladder.

It is a further object of the present invention to provide a composite ladder which allows the inner side rails to slide relative to the outer slide rails, but to remain interlocked in a manner which is not easily overcome by the stress placed upon the ladder.

It is a still further object of the present invention to provide a composite ladder constructed such that the forces applied to portions of the side rails are transferred and spread throughout the entire slide rail thereby benefiting from the strength of the larger surface area of fiber.

It is a concomitant object of the present invention to provide accessories for ladders and scaffolding that facilitate stability and promote safety during the operational use thereof.

It is another concomitant object of the present invention to provide accessories for ladders and scaffolding that facilitate preservation of fragile and expensive surfaces.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a ladder is provided which is lightweight and non-electrically conductive. This is achieved in part by constructing the ladder of prestressed single filament wound fibers which are integrated into a resin matrix to form a strong composite material. Additional advantages are achieved by constructing the ladder with rungs which are molded integrally with the side rails.

As discussed above, those skilled in the art have encountered several significant problems in constructing a versatile, lightweight, fiberglass ladder according to prior art methods. Two features which significantly contribute to the strength of the present invention are: (1) the orientation of continuous strand, filament wound fibers within the composite material of both the side rails and the rungs and, (2) a prestressing (stretching) of the filament strands prior to and during the curing cycle of the resin matrix. A proper orientation of the prestressed fibers increases the strength and stability of the side rails such that the fiberglass in the finished product does not need to be as thick as has heretofore been required in order for the ladder to be capable of withstanding the pressures and stresses of normal use.

The inherent weakness in the flexural, bearing and transverse strengths of the unidirectional fiberglass of the prior art can be overcome by angularly orienting the fiber in the fiberglass with respect to the longitudinal axis of the respective side rail and then prestressing the fibers prior to hardening of the matrix. In order to achieve this angular orientation of the fibers as well as the radial prestressing of the fibers, it is necessary to use a molding process to form the composite parts of the ladder. A pultrusion process does not prestress fibers and can only exert a force along the longitudinal axis of the side rail.

To construct the instant invention, the fibers within the side rails of the ladder are first filament wound around an expandable mandrel and angularly oriented with respect to each other and with respect to the longitudinal axis of the side rails. The side rails are then placed in a mold and the expandable internal mandrel on which the filaments are wound is expanded. This expansion prestresses the fibers and forces the resin in the molds to the outer interior of the mold. The pressure caused by the expanding mandrel can be used to force the resin into patterns etched into the mold such as patterns designed to provide traction on the rungs etc. After the resin is cured, the internal mandrel is contracted and the fibers remain stressed within the hardened composite. The mandrel is coated with a non-stick material to prevent bonding to the composite material. To achieve both the "C" shaped upper rail and the rectangular-shaped lower rail in one piece, the internal mandrel for the upper portion of the outer side rail is removed prior to final curing allowing the fibers in that area to collapse into the "C" shape prior to final curing of the resin.

The rungs and side rails are also integrally molded to provide superior strength. This integral molding is accomplished by placing the side rail in the mold and prestressing the fibers, then inserting rung inserts into rung access holes formed in the mold. The rungs are then tightly clamped to the side rail mold assembly and the rail is cured to the "B" stage only to allow the mold to be removed and the rungs to also be placed into the opposing side rail mold prior to final curing of the entire assembly of opposing side rails and rungs. In an alternate embodiment, an end cap is inserted into the interior of the rung to provide additional rung and rail strength. The end cap is inserted from a side opposite the side the rung is inserted into the side rail. The rungs, the end cap and the rail are then finally cured as a homogenous piece from the "B" stage.

An interlocking tongue and groove arrangement is employed between the outer side rail and the inner side rail. The inner rail slides through the upper section of the outer rail when used as an extension ladder. The inner side rail is contained within the "C" shaped channel of the upper outer side rail and is also attached with a interlocking tongue and groove arrangement. This allows the upper section of the outer rail to absorb the torsional loads of the channeled portion of the inner side rail through the interlocking tongue and groove section thereby converting torsional loads into stress loads which are dispersed throughout the fabric of the entire upper half of the outer rail. The strength is thereby greatly multiplied in the most critical area of stress and allows the thickness of the fiberglass material to be decreased thereby lightening the ladder.

Because the ladders of the present invention are made of nonconducting composite materials, they are capable of being used under conditions where electricity may be present. Moreover, the design of the present invention provides for a lightweight and highly versatile ladder, which functions as both a combination step and extension ladder. The fiberglass ladders of the present invention can therefore be used for a variety of construction and home purposes and by individuals not possessing the strength to operate conventional heavier ladders.

Some embodiments within the scope of the present invention utilize remotely lockable hinges. These hinges are designed so as to be locked and unlocked from a fixed location on the outer side rails. This configuration allows a user to lock or unlock the hinges even when they are located beyond their reach. Thus, as ladders within the scope of the present invention are extended so that the hinge is above the users reach, operation of the hinge may still be affected.

Accessories accompanying the ladder are provided which facilitate stability and promote user safety during operational use thereof. These accessories include comer brackets, tree and pole calipers and standoff attachments. Other accessories are also provided which afford ground surface stability for the ladder during operational use and include pivotal rail shoes having removably attachable pads arranged as grass cleats and ice spikes. Cushion pads adaptive to both the rail shoes and the standoff arrangements are provided to facilitate the preservation of fragile and expensive surfaces. Additionally, an adapter is described that allows the conversion of a conventional ladder into a trestle support.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which:

FIG. 4A is an illustration of the molding process used in the present invention and a rung made there from;

DETAILED DESCRIPTION OF THE PREFERRED EMBODIMENTS

The invention is best understood by reference to the drawings wherein like parts have like numerals throughout. Although the embodiments and method of manufacture of the present invention discussed herein are that of a combination step and extension ladder, it will be appreciated that the structure and method of manufacturing disclosed may be applied to other types of ladders made of composite materials, such as single function step ladders or extension ladders.

The present invention is directed to ladders manufactured from composite materials. Specifically, materials used in the manufacture of this invention comprise a fiber or filament integrated into a matrix binder. As used within the scope of this invention, fiber or filament includes fibers and fiber fabric material made of glass, aramid, graphite, ceramic, or ceramic plastic. As used within the scope of this invention, the terms resin or resinous material should be constructed to include a suitable matrix binder for use with the selected fiber or filament. Resins contemplated within the scope of this invention include ceramic or polyester matrix binders. Catalysts for use with the fiber/resin system, which must be suitable for the selected fiber and resin, include benzoyl peroxide and other well known catalysts.

The choice of the particular material to be employed is influenced by traditional factors such as cost and operating environment. For example, a ceramic-based composite material can be used for environments where high temperatures are encountered. Because of economic considerations, a type "E" glass fiber well known to those skilled in the art may be preferred. If, however, a high strength-to-weight ratio is desired, an organic aramid fiber such as sold by E. I. DuPont de Neumours & Co. under the trademark "Kevlar 49" may be preferred.

Figure 1:
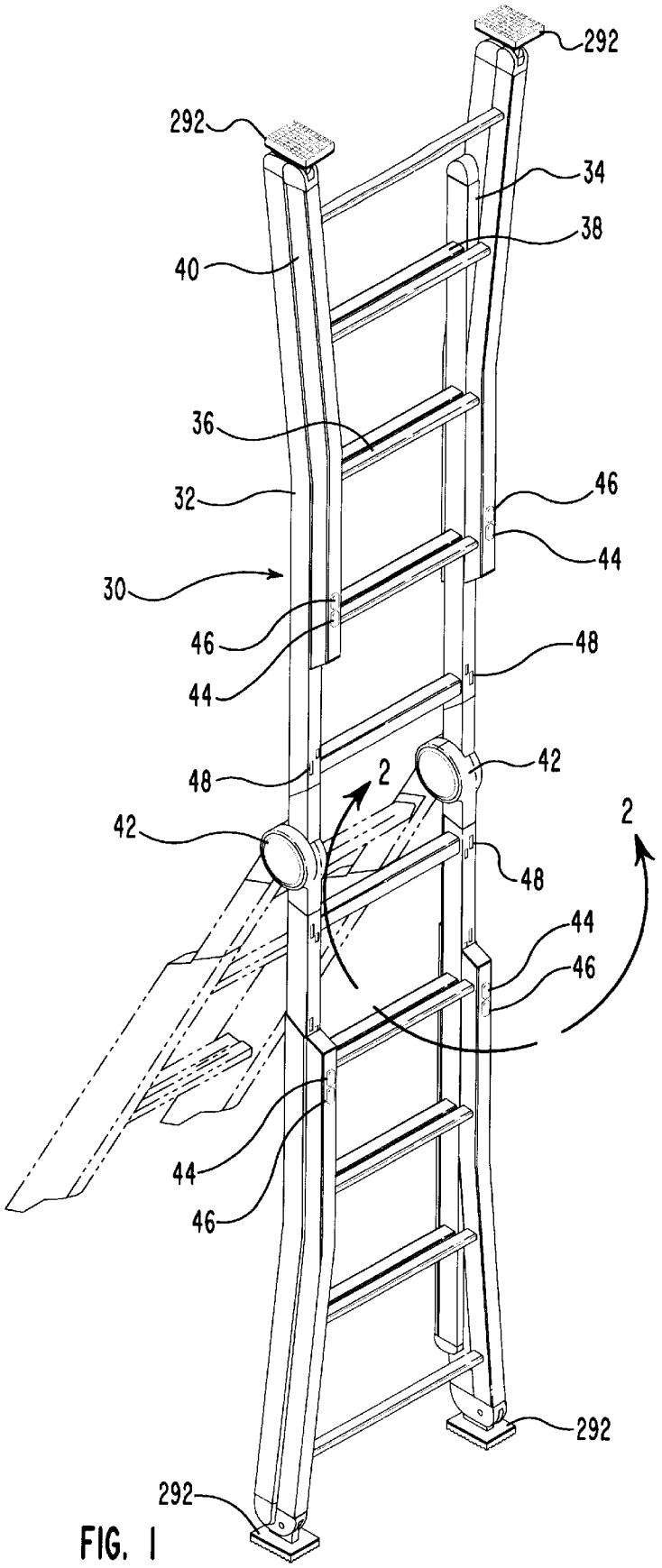
FIG. 1 is a perspective view of a combination step and extension ladder within the scope of the present invention.

FIG. 1 depicts a combination step and extension ladder, shown generally as 30. The combination step and extension ladder generally comprises two identical sides, each of which comprise a pair of outer side rails 32 connected together with a set of outer rungs 36 and a pair of inner side rails 34 connected together by a set of inner rungs 38. The inner side rails 34 slide in telescopic relation to outer side rails 32. Each side is capable of extending independent of the other side. The outer side rails 32 may be flared toward the bottom portion 40 for increased stability. The two sides are joined by a pair of remotely lockable hinges 42 which can be operated from a remote actuator 44 located at a fixed location on the outer side rails. Thus, remotely lockable hinges 42 may be operated even when hinge 42 is out of the operator's reach.

The solid lines in FIG. 1 depict the combination step and extension ladder 30 locked into its extension ladder configuration. The dashed lines in FIG. 1 depict the combination step and extension ladder folded in a step ladder configuration. FIG. 1 illustrates the ability of the remotely lockable hinges 42 to be locked into a number of fixed positions. The hinges may be manufactured to lock in any desired combination of positions. In one preferred embodiment within the scope of the present invention, remotely lockable hinges 42 are manufactured such that they are capable of locking the two sides of the ladder with relative angles of 0 degrees, 30 degrees, 40 degrees, and 180 degrees. In another preferred embodiment within the scope of the present invention, remotely lockable hinges 42 are manufactured such that they are capable of being locked in fixed degree increments, like 0 degree to 180 degree in 20 degree increments.

The combination step and extension ladder 30 also contains means for locking inner side rails 34 at a fixed telescopic location relative to outer side rails 32. In FIG. 1, the means for locking inner side rails 34 relative to outer side rails 32 is actuator mechanism 46. In this embodiment, the actuator mechanism 46 is located adjacent to the remote actuator 44 which operates remotely lockable hinges 42. Actuator mechanism 46 shown in FIG. 1 engages a series of actuator holes 48 located in inner side rails 34.

Figure 2:
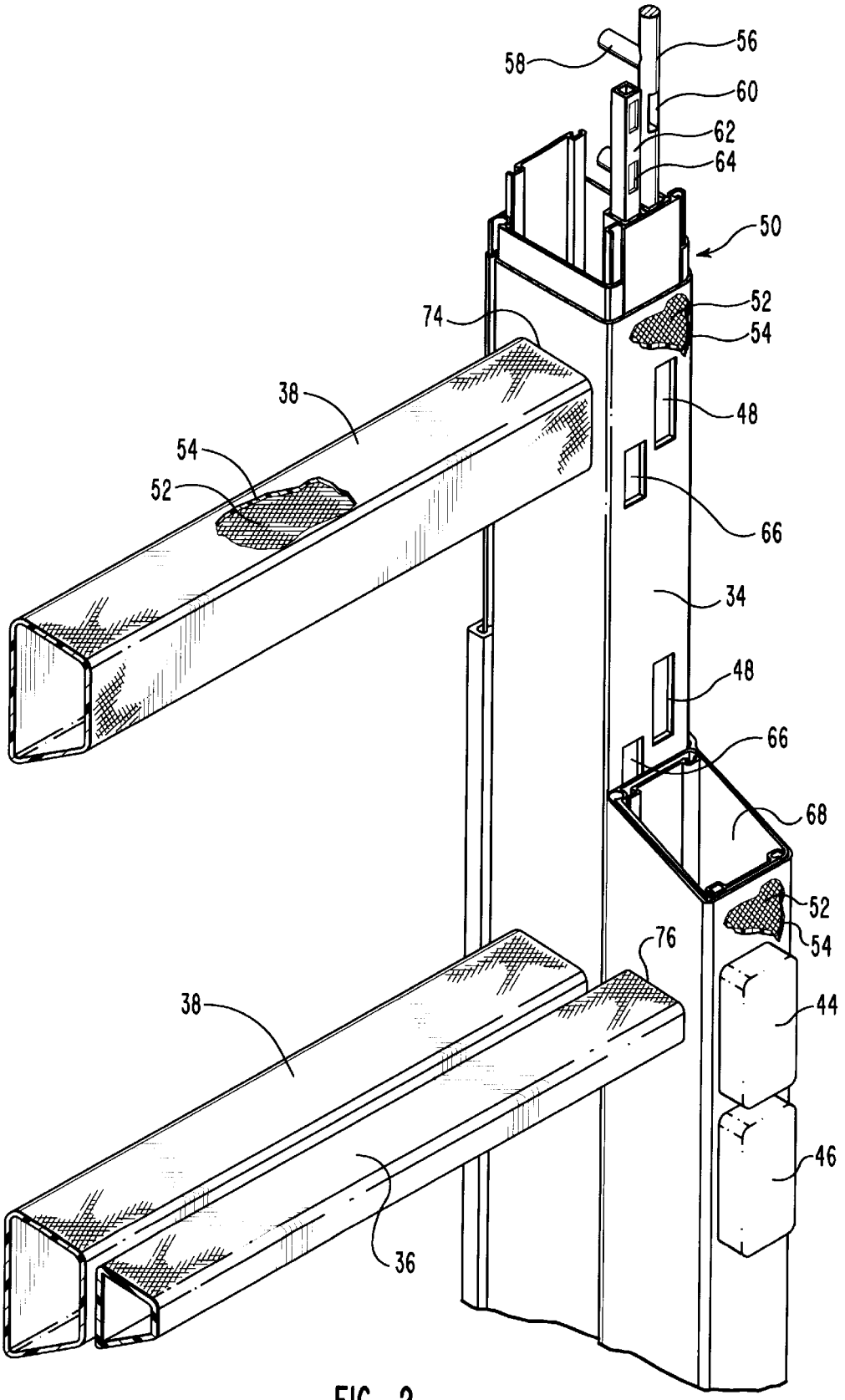
FIG. 2 is a fragmentary perspective illustration of one side of a combination step and extension ladder.

FIG. 2 shows a cut-a-way of one side taken along line 2—2. Referring first to inner side rail 34, a general principal of construction is illustrated. The general construction comprises a inner core 50, and bias wound filament 52 which is impregnated with catalyst containing resin 54. The inner core 50 is designed to expand in circumference in order to prestress bias wound filament 52 and force a layer of resin 54 to coat filament 52. In this particular embodiment, inner core 50 is manufactured from discrete pieces which slide relative to each other. As the pieces are slid relative to each other, the circumference of inner core 50 expands. Other methods of expanding inner core 50 may also be employed. Depending on the material used, the inner core may be expanded mechanically, hydraulically, pneumatically, or chemically.

The general method of constructing the side rails is to relax or contract the inner core 50 to its unexpanded state and then to bias wind an appropriate filament 52 impregnated with an appropriate catalyst containing resin around inner core 50. After filament 52 has been bias wound around inner core 50, inner core 50 is expanded circumferentially to prestress bias wound filament 52. As filament 52 is prestressed, resinous material 54 is forced from filament 52 and coats bias wound filament 52.

The outer side rail comprises an outer rail core assembly 68 around which bias wound filament 52 coated with catalyst containing resin 54 is placed and then prestressed. Furthermore, in this particular preferred embodiment, inner rungs 38 and outer rungs 36 are also constructed of bias wound filament 52 coated with catalyst containing resin 54. It will be appreciated, that when the side rails and rungs are manufactured from the same material that the entire assembly may be manufactured in a single unitary section. A single unitary section may be created either by forming and curing the entire section together, or forming and curing some individual components to the "B" stage and then assembling the "B" stage components into a section being formed and post-curing the entire section.

As illustrated in FIG. 2, when filament 52 is wound around inner core 50, outer rail core assembly 68, inner rungs 38, or outer rungs 36, filament 52 is wound so that the resultant fibers are angularly orientated with respect to the longitudinal axis of the particular member being constructed. Proper orientation of the fiber relative to the longitudinal axis of the particular members overcomes the difficulties encountered in the prior art with reduced flexural, transverse, and bearing strengths due to unidirectionally oriented fibers.

The smaller the fiber orientation angle (the closer the fibers are aligned with the longitudinal axis), the greater the strength in the longitudinal direction; the larger the fiber orientation angle, the greater the bearing and transverse flexural strengths. Hence, a relatively larger is preferred for outer side rails 32 which must support greater transverse and flexural forces. A smaller fiber orientation angle is sufficient for inner side rails 34 since most of the forces exerted on them are longitudinal.

Prestressing filament 52 during the construction process results in greatly improved transverse and flexural strengths as well as increased bearing, tensile, and compression strengths. The strengths achieved by prestressing filament 52 during the manufacturing process are greatly improved over anything previously available in the prior art. This unique manufacturing process thus represents a significant advancement over the prior art.

In the particular preferred embodiment shown in FIG. 2, transfer shaft 56 is included. Transfer shaft 56 has a plurality of transfer rods 58 extending therefrom and a plurality of transfer holes 60 formed therein. Transfer shaft 56 fits inside inner core 50 of inner side rail 34. When transfer shaft 56 is placed within the inner core 50, transfer rods 58 engage inner rungs 38 and transfer holes 60 are aligned with actuator holes 48.

The purpose of transfer shaft 56 is to distribute stresses from actuator mechanism 46 among all inner rungs 38. A secondary purpose of transfer shaft 56 is to distribute any stress placed on a single inner rung amongst all remaining inner rungs 38. By distributing the stresses placed on a single rung or the stresses placed on inner side rail 34 by actuator mechanism 46 amongst all inner rungs 38, the material used in manufacturing the particular stress point around actuator hole 48 may be reduced and the overall weight of the ladder commensurately reduced.

Remotely lockable hinges 42 used in manufacturing this particular preferred embodiment contain means for remotely operating the hinge. In FIG. 2, the means for remotely operating the hinge comprises remote actuator 44 and remote actuator bar 62. Remote actuator bar 62 is placed within inner core 50 so as to be capable of sliding relative to inner core 50. Formed within remote actuator bar 62 are a plurality of remote actuator bar holes 64. Remote actuator bar holes 64 align with remote actuator holes 66 formed within inner side rails 34 when remote actuator bar 62 is placed within inner core 50. The purpose of remote actuator bar 62 is to transfer motion from remote actuator 44 to remotely lockable hinge 42 located at the top of inner side rail 34.

Actuator mechanism 46 which locks inner side rail 34 at a fixed location relative to outer side rail 32 and remote actuator 44 which operates remotely lockable hinge 42 are placed within outer side rail 32. Each actuator is contained within its own housing. When outer side rail 32 is manufactured, holes for remote actuator 44 and actuator mechanism 46 are cut into the side rail. An insert (not shown) is then placed into the holes and the actuator mechanisms inserted into the insert. In this manner, the material surrounding remotely actuator 44 and actuator mechanism 46 is reinforced so as to bear any stress placed upon actuator mechanism 46. Formed within inner side rail 34 is a plurality of inner rung receiving holes 74. Inner rung receiving holes 74 are sized and shaped to receive corresponding inner rungs 38. Formed within outer side rail 32 are a plurality of outer rung receiving holes 76. Outer rung receiving holes 76 are sized to receive corresponding outer rung 36. In this particular preferred embodiment the rungs and side rails are manufactured from the same material so that the rungs and side rails may be formed into a single unitary structure thereby eliminating the need to bond the rungs into the side rail and eliminating the problems associated with such bonding.

Figure 3A:
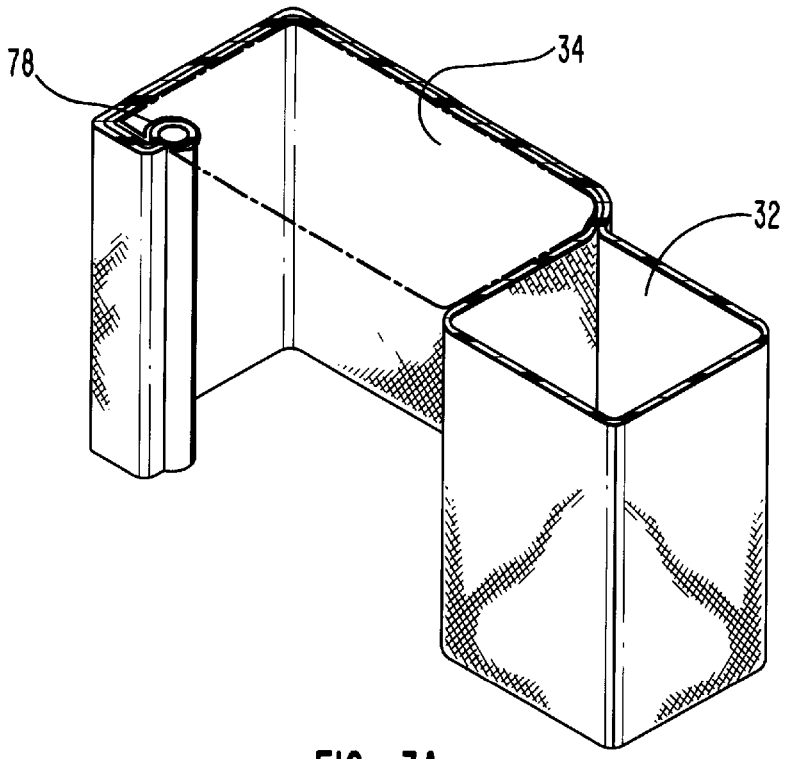
FIG. 3A is a fragmentary perspective of one embodiment of the connection between the inner and outer side rails.

Because inner side rails 34 and outer side rail 32 slide telescopically in relation to each other, a means for attaching inner side rail 34 to outer side rail 32 must be developed which allow this sliding motion. In FIG. 3A this means is illustrated as interlocking tongue and grove joint 78 between inner side rail 34 and outer side rail 32. The construction of interlocking tongue and groove joint 78 not only serves to allow telescopic motion between inner side rail 34 and outer side rail 32 but also serves a unique stress transfer function. As disclosed in the background section, when a load or weight is exerted on an outer rung, a torsional load is generated on outer side rail 34. The prior art methods of retaining inner side rail 34 within outer side rail 32 allowed this torsional load to drive the two side rails apart sometimes resulting in catastrophic failure of the ladder. Interlocking tongue and groove joint 78 illustrated in this preferred embodiment transfers the torsional load of outer side rail 32 into inner side rail 34. This converts the torsional load into a stress load which is dispersed through the fabric of outer side rail 32. In addition, interlocking tongue and groove joint 78 prevents inner side rail 34 from escaping outer side rail 32. Thus any possibility of catastrophic failure of the ladder due to the torsional load generated on outer side rail 32 is greatly minimized.

Figure 3B:
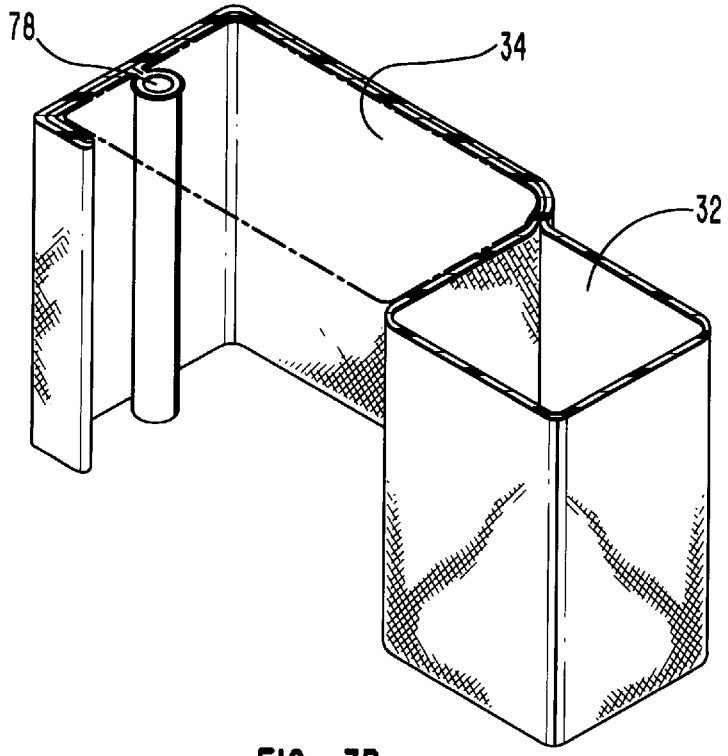
FIG. 3B is an alternate embodiment of the connection between the inner and outer side rails.

FIG. 3B depicts an alternate embodiment for the means for connecting the inner side rail 34 to the outer side rail 32. In this embodiment, interlocking tongue and groove joint 78 is formed between the inner side rail 34 and outer side rail 32 along one edge of the inner side rail. It will be appreciated, that such a interlocking tongue and groove joint may be formed in any location along the inner face between inner side rail 34 and outer side rail 32.

Figure 3C:
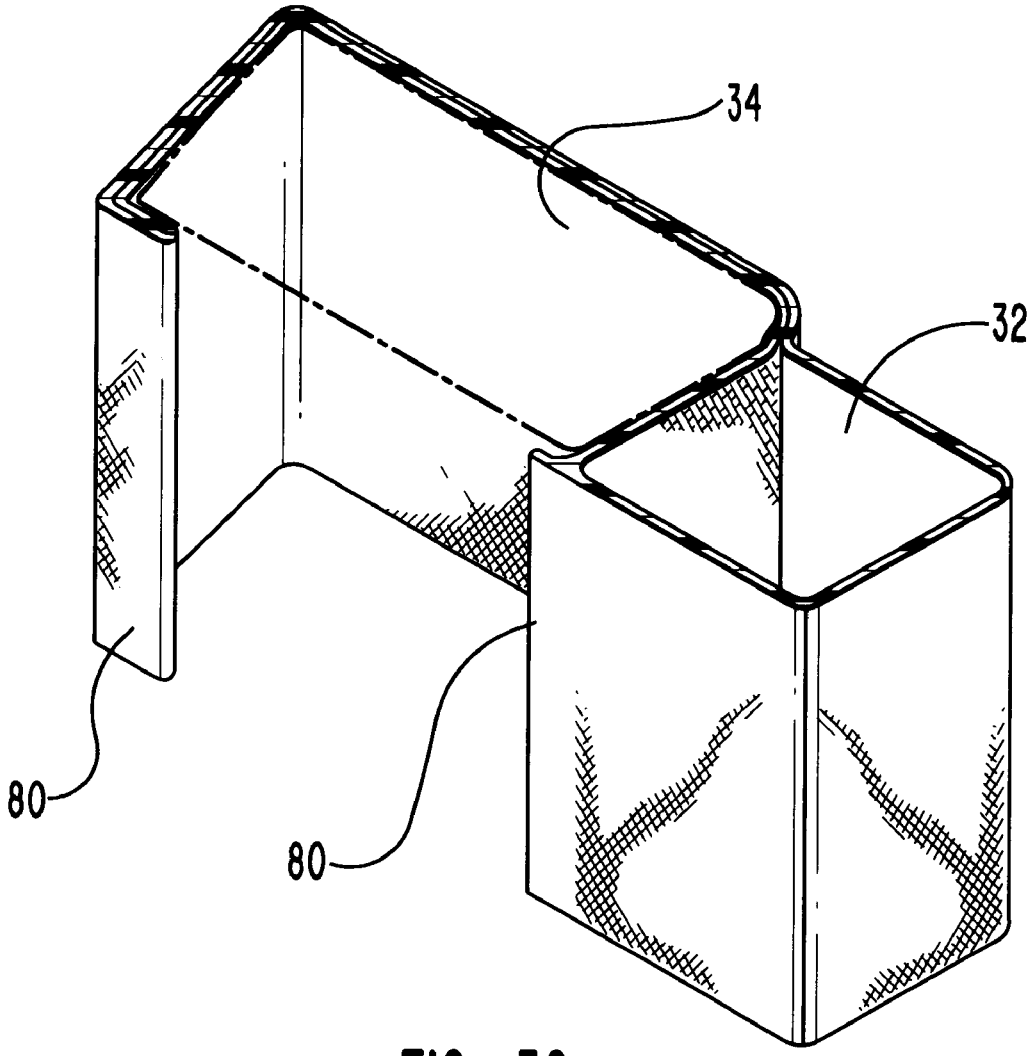
FIG. 3C is another alternate embodiment of the connection between the inner and outer side rails.

In FIG. 3C the means for connecting inner side rail 34 to outer side rail 32 comprises an inner side rail 34 with a non-rectangular cross section around which a corresponding outer side rail 32 is placed. The outer side rail is thus formed in a modified C-channel configuration. As used within this patent, C-channel refers to any configuration where outer side rail 32 at least partially encloses inner side rail 34. Additionally, small extended portions 80 may be formed within outer side rail 32 in order to further enclose outer side rail 34. Obviously, any such extended portions must still leave inner side rail 34 free to slide telescopically in relation to outer side rail 32.

Figure 4A:
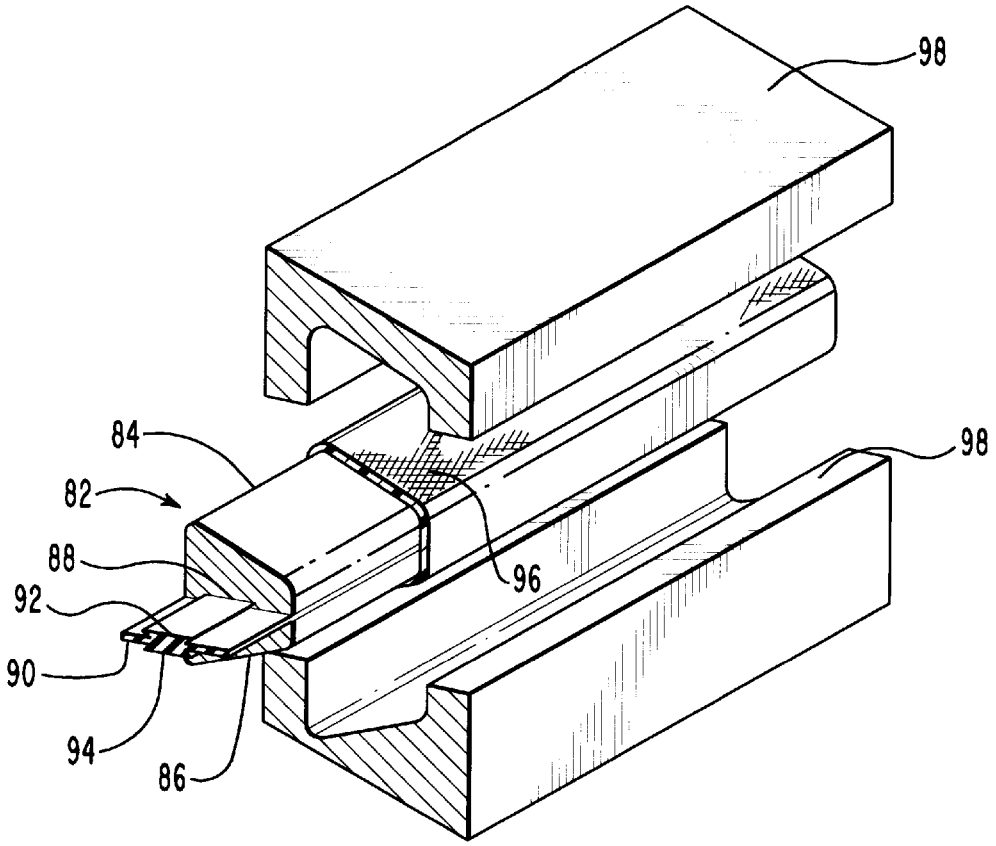

FIG. 4A illustrates the manufacture of ladder rungs which are suitable for use within the present invention from prestressed bias wound filaments. Also, the following discussion will further serve to illustrate the general process of manufacturing components from prestressed bias wound filaments embedded in resinous material.

Central to the manufacturing process within the scope of the present invention are the use of expandable mandrels around which filaments may be bias wound. Mandrels of various shapes and sizes are used in methods of manufacture within the scope of the instant invention.

In FIG. 4A a mandrel suitable for use in manufacturing ladder rungs is shown generally as 82. Mandrel 82 comprises top core section 84 and bottom core section 86. Top core section 84 and bottom core section 86 have formed therein guide slot 88. Expandable mandrel 82 also comprises center core section 90. Center core section 90 has formed thereon top core guide 92 and bottom core guide 94. Center core section 90 is tapered along its length so that top core section 84 and bottom core section 86 are forced apart when top core section 90 is inserted therebetween. Top core guide 92 and bottom core guide 94 engage guide slots 88 of the respective top core section 84 and bottom core section 86.

As center core section 90 is inserted between top core section 84 and bottom core section 86, the top core section 84 and bottom core section 86 are forced apart and mandrel 82 expands. As center core section 90 is withdrawn from between top core section 84 and bottom core section 86, top core guide 92 and bottom core guide 94 engage guide slots 88 of top core section 84 and bottom core section 86 and force top core section 84 and bottom core section 86 together. Thus, once a part is formed around the mandrel, withdrawing the center core section will cause the outer circumference of the mandrel to shrink and facilitate withdrawing the mandrel from the inside of the part being formed. Mandrels may also be coated with a non-stick coating to facilitate removal of the mandrel.

As illustrated in FIG. 4A, a suitable filament 96 impregnated with catalyst-containing resin is wound around mandrel 82 with center core section 90 partially withdrawn. Filament 96 is bias wound around mandrel 82 so that the filament fibers are angularly oriented with respect to the longitudinal access of mandrel 82.

The fibers are deposited upon the circumferential surface of mandrel 82 through helical turns of filament 96 extending continuously from one end of mandrel 82 to the other. The fibers are deposited so as to transverse in one direction along mandrel 82 and then in the opposite direction upon returning. The successive layers of resinous coated filament form a fiberglass winding in which the layers of the fiber lie in a crisscross or "X" relationship relative to the longitudinal access of mandrel 82. The fiber layers formed according to this method are referred to as bias wound fiber or filament.

After mandrel 82 has been covered to the desired thickness, it is placed into mold 98. As illustrated in FIG. 4A, mold 98 is divided into two halves which may be removed after the ladder rung is formed. After mold 98 has been securely clamped together the mandrel is expanded by pressing center core section 90 fully between top core section 84 and bottom core section 86. As mandrel 82 is expanded, catalyst containing resin is forced from filament 96 to the surface of mold 98 thus encasing filament 96 within a layer of resinous material. The expansion also prestresses filament 96 thereby achieving greatly increased transverse flexural bearing, tensile, and compression strengths. The expansion of mandrel 82 may be used to force resinous material into designs or impressions contained on the inside of mold 98. This process may be used, for instance, to form rungs with roughened or raised tread sections to reduce the probability of slipping.

A useful characteristic of most resin systems is the ability to limit the curing of the resin to what is referred to by those skilled in the art as a "B" stage. This is a state in which the resin becomes rigid but will still molecularly bond to additional applications of catalyst-containing resin to form a homogeneous material when post-cured. Post-curing elevates the resin system to a fully cured state. According to one method of manufacture within the scope of the present invention, rungs manufactured from prestressed composite material as herein described are first cured to the "B" stage. The rungs are then assembled into side rails and the entire assembly is thereafter post-cured to form a unitary ladder from a homogeneous material.

Figure 4B:
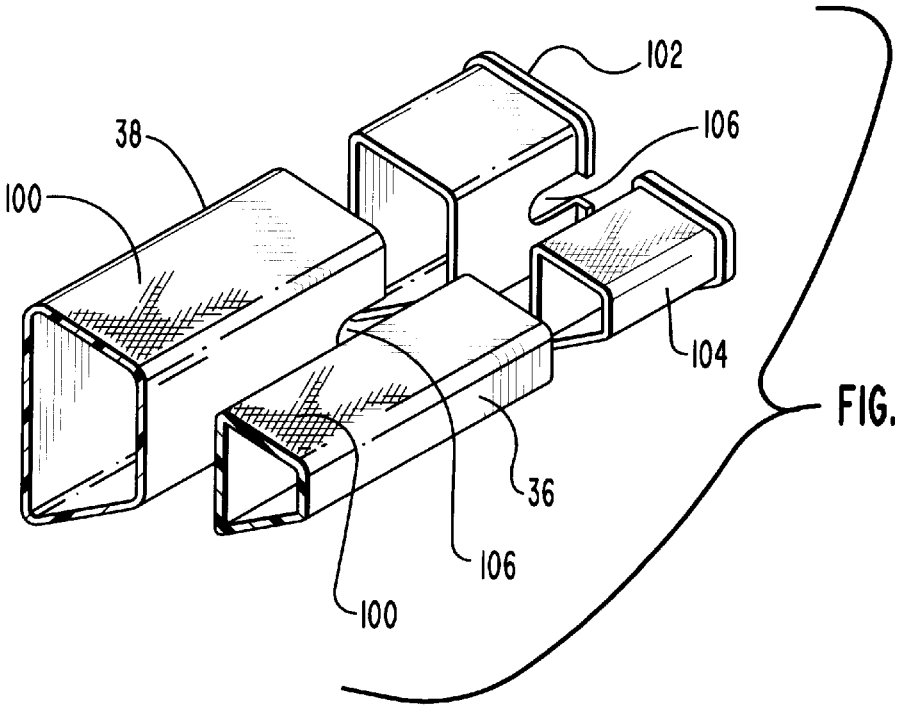
FIG. 4B is a perspective of inner and outer rungs assemblies within the scope of the present invention.

FIG. 4B depicts a typical set of inner rungs 38 and outer rungs 36 manufactured according to the process just described. In one preferred embodiment, inner rungs 38 and outer rungs 36 are of generally trapezoidal cross-section. Stepping surfaces 100 are angled so as to be essentially co-planar when inner rungs 38 and outer rungs 36 are vertically aligned. Aligned stepping surfaces 100 form an extended surface which is essentially horizontal whenever the ladder is placed in an upright but slightly angled position.

Inner rungs 38 are provided with inner rung inserts 102 and outer rungs 36 are provided with outer rung inserts 104. The rung inserts are designed to fit within the corresponding rung and help to strengthen the end of the rung where it is molded into the side rail. Inner rung insert 102 and outer rung insert 104 are manufactured from prestressed bias wound fibers oriented at an angle with respect to the longitudinal axis of the insert according to the method previously described. The inner and outer rung inserts are cured to the "B" stage before assembly in order that a unitary rung assembly may be formed from a rung and rung insert.

Inner rung 38 and inner rung insert 102 are provided with transfer rod interface 106. Transfer rod interface 106 is designed to engage transfer rods 58 when inner rung 38 is assembled into inner side rail 34. Transfer rods 58, through transfer shaft 56, distributed any load placed on the rung or transfer shaft 56 to all remaining rungs 38.

Figure 5:
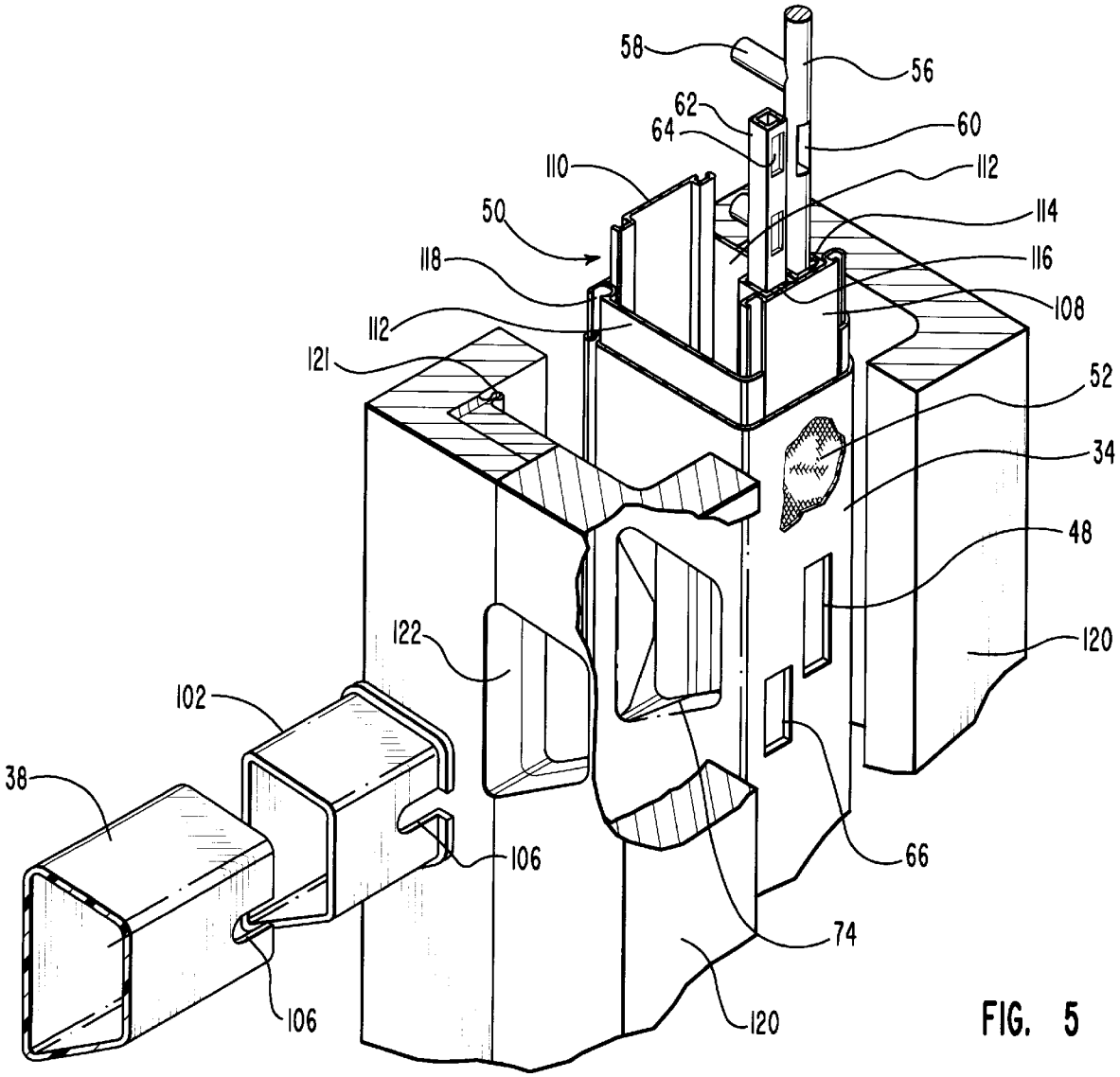
FIG. 5 is an illustration of the molding process used to manufacture the inner side rails.

FIG. 5 illustrates in greater detail how inner side rail 34 is manufactured in one preferred embodiment. In this preferred embodiment, inner core 50 is formed from a front slide section 108, a rear slide section 110 and two side core sections 112. The front slide section 108, the rear slide section 110 and the two side core sections 112 are assembled using interlocking joints which only allow the pieces to slide vertically relative to each other along their longitudinal axis. The interlocking joints are so configured as to prohibit motion in any other direction. Front slide section 108 and rear slide section 110 are tapered along their longitudinal axis so that as front slide section 108 and rear slide sections 110 are inserted, the circumferential distance of inner core 50 expands.

Side core sections 112 are also provided with inner rung receiving holes 74 which are sized and shaped so as to receive inner rungs 38. Front slide section 108 is provided with actuator holes 48 and remote actuator holes 66. Front slide section 108 is also provided with transfer shaft channel 114 and remote actuator bar channel 116. Transfer shaft channel 114 is sized and shaped to receive transfer shaft 56. Remote actuator bar channel 116 is sized and shaped to receive remote actuator bar 62. When transfer shaft 56 is placed within transfer shaft channel 114 transfer holes 60 are aligned with actuator holes 48 and transfer rods 58 are aligned with inner rung receiving holes 74 so that transfer rod interface 106 of inner rung 38 and inner rung insert 102 are engaged. When remote actuator bar 62 is placed within remote actuator bar channel 116 remote actuator bar holes 64 are aligned with remote actuator holes 66.

In one preferred embodiment, one side core section 112 is provided with interlocking groove 118. Interlocking groove 118 forms one-half of interlocking tongue and groove joint 78.

Manufacture of inner side rail 34 proceeds generally as follows. Inner core 50 is partially assembled with two side core sections 112 and front slide section 108 and rear slide section 110 partially withdrawn from inner core 50. Filament 52, which is coated with catalyst containing resin, is bias wound over inner core 50 so that a bias wound fabric is created with the fibers oriented at an angle relative to the longitudinal access of inner core 50. Filament 52 is wound in the same way as the filament is wound around mandrel 82 as described in the section detailing manufacture of inner rungs 38 and outer rungs 56 above. Filament 52 should be wound so that the angle of the fibers with the longitudinal axis of side rail 34 does not significantly exceed about 45 degrees. Angles in the range from about 10 degrees to about 25 degrees are presently preferred for the fiberglass material used to manufacture inner side rails 34.

Once the appropriate thickness of bias wound fabric is created, mold 120 is clamped around the assembly. After mold 120 has been securely clamped around the assembly, the front slide section 108 and rear slide section 110 are fully advanced into the assembly thereby causing inner core 50 to expand and prestressed the fabric created from filament 52. Expanding inner core 50 also forces some of the catalyst containing resin to the surface of mold 120 so that filament 52 is encased within a layer of catalyst containing resin.

When mold 120 is clamped around the assembly, mold section 121 presses filament 52 inward forming interlocking groove 118. Mold section 121 is capable of expanding so as to prestress filament 52 around the inside of interlocking groove 118. Once mold 120 has been securely clamped around the assembly, mold section 121 and inner core 50 are expanded simultaneously so as to achieve uniform prestressing of filament 52.

Inner rung receiving holes 74 are then created in the assembly by piercing or cutting the fabric exposed through access holes 122. In one preferred embodiment, the fabric is cut in roughly an "X" manner and the fabric layers folded inward into inner rung receiving hole 74. Remote actuator holes 66 and actuator holes 48 are created in a similar manner.

The transfer shaft 56 is then placed within transfer shaft channel 114 and inner rungs 38 and inner rung inserts 102 are placed within access holes 122 so as to extend into the inner rung receiving hole 74 formed within inner side rail 34.

Within the scope of the present invention, rungs and both side rails of one complete ladder section may be assembled and cured together. If this method is employed, the curing temperature and curing time may be adjusted so as to bring the entire assembly into a post-cured condition. If, however, rungs are being cured into only one side rail section at a time, care must be taken to bring the curing cycle only to the "B" stage so as to preserve this state in the rungs until they are molded into the second side rail. The entire assembly may then be post-cured at the time the second side rail and rungs are assembled. During the post-cure cycle the rail sections and corresponding rungs become integrally molded into a single homogeneous material to form a unitary ladder section.

In addition to expandable inner core 50 illustrated in FIG. 5, other expandable inner core embodiments may also be used. For example, inner cores which may be expanded mechanically, hydraulically, pneumatically, or chemically are also appropriate for use in this invention. The materials may be fiber/resin combination or other materials which are suited to the specific environment under consideration. For example, cores of lightweight metal, foam, polymer plastic, or other appropriate material may be used.

Figure 16:
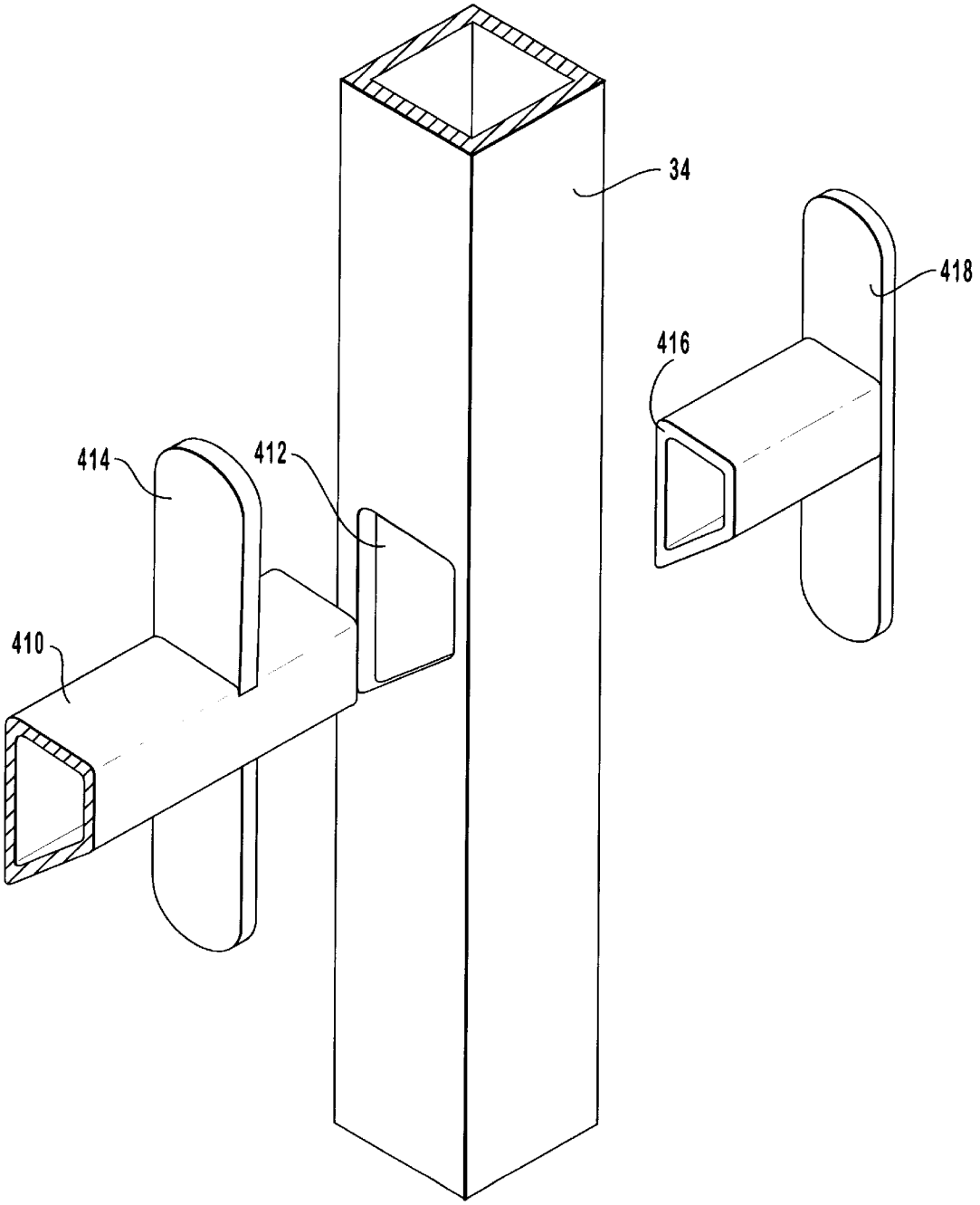
FIG. 16 is a perspective view of an alternative embodiment of a rung attachment.

With reference to FIG. 16, an alternate embodiment for attaching a rung 410 to the rail section 34 of the present invention is depicted. In this embodiment, rung 410 is exemplary of either the inner or outer rungs and their method of manufacturing as previously described. A hole 412 is introduced into rail section 34 and the rung 410 is inserted therein until the rail stop 414 abuts against the rail section. Into the rung, from a side opposite the side of the rail section that the rung is inserted, an end cap 416 is inserted until the end stop 418 abuts against the rail section. In this manner, both the rail and rung are provided with additional strength. During use, the end cap serves to effectively dissipate the load exerted upon the rail and the rung. Similar to other embodiments, this embodiment is assembled during the "B" stage of curing so that upon final curing, the rungs, the end cap and the rail are homogeneously cured together as a singular piece.

Figure 6A:
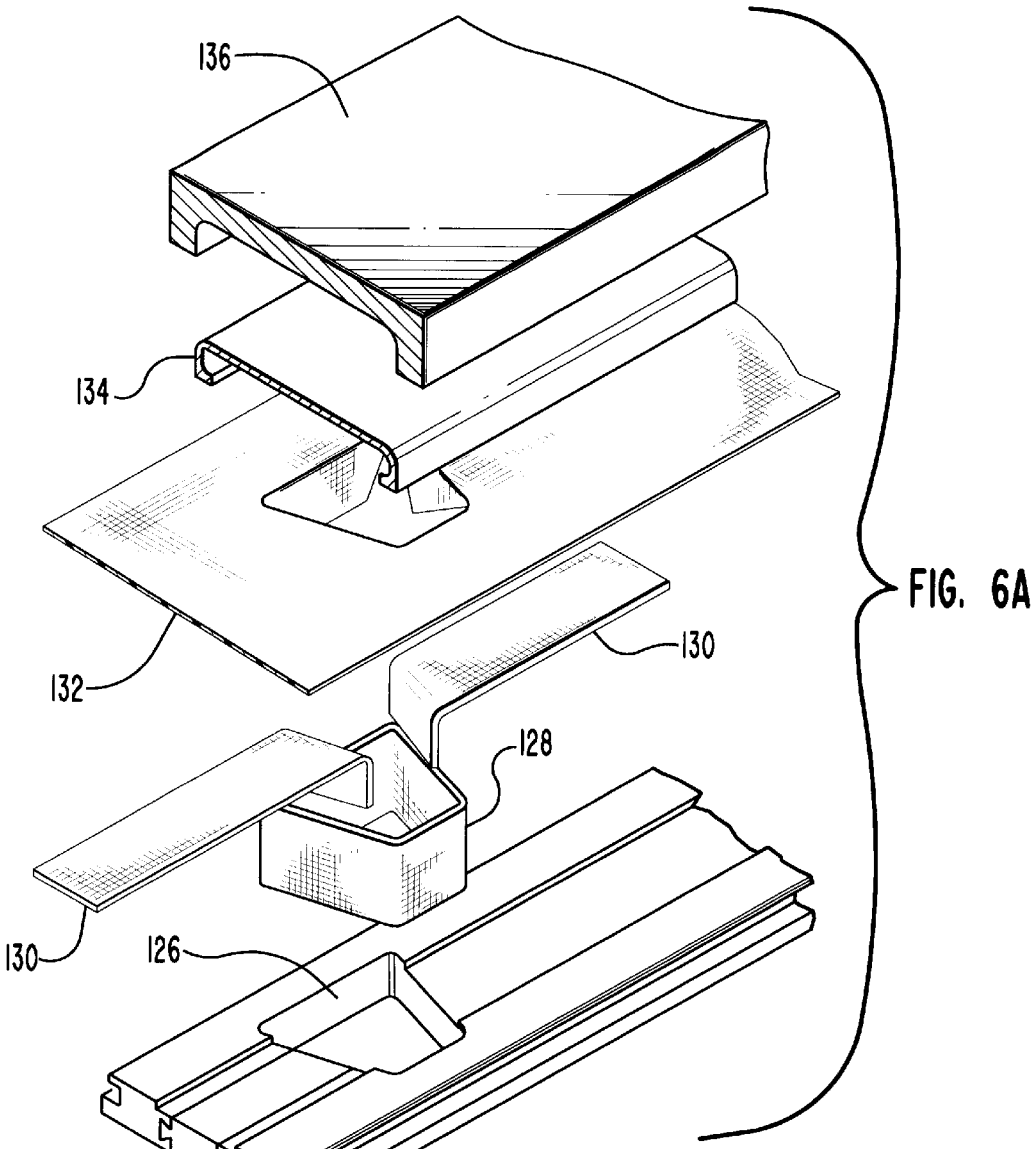
FIG. 6A is a perspective illustration of the method of constructing one embodiment of the expandable inner core used in the inner side rail.

FIG. 6A illustrates a method by which side core sections 112, front slide section 108 and rear slide section 110 are produced. Mandrel 124 used in forming side core sections 112 has stress ring holes 126 located along its lengths where inner rung receiving holes 74 are to be formed. Mandrel 124 is formed with tapered center core 125 so that mandrel 124 can be expanded in a direction perpendicular to its longitudinal axis. Thus, construction of mandrel 124 is similar to mandrel 82 used in manufacturing rungs.

In one preferred embodiment, stress ring 128 is pressed into stress ring hole 126. Stress ring 128 is formed by winding unidirectional fibers saturated with catalyst-containing resin around the circumference of an expandable mandrel. A mold is placed around the mandrel and the mandrel expanded to prestress the fibers and the stress ring cured to the "B" stage.

Figure 6B:
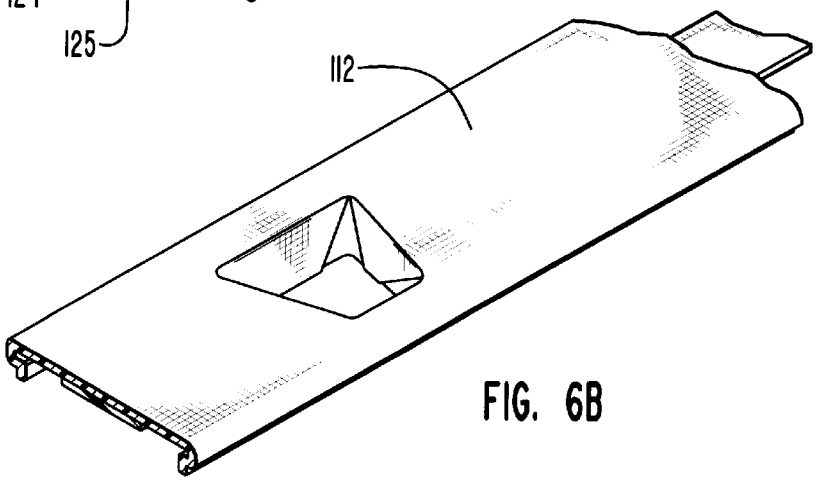
FIG. 6B is a perspective of part of the expandable inner core used in the inner side rail.

After stress ring 128 is placed into stress ring hole 126, stress strips 130 are laid onto mandrel 124 so that the ends extend into stress ring 128. Core sheet 132 is then placed over mandrel 124 so as to cover stress strips 130. Both stress strips 130 and core sheet 132 comprise a fabric of suitable type for the selected fiber/resin system where the fabric fibers are oriented perpendicular and parallel to the longitudinal access of mandrel 124. The fabric of stress strips 130 and core sheet 132 are preferably saturated with catalyst-containing resin before being placed onto mandrel 124. Core sheet 132 is then pierced or cut to create a hole corresponding to stress ring 128. In one preferred embodiment, the piercing or cutting of core sheet 132 is a roughly "X" shaped pattern. The fabric is then folded into the stress ring 128. A caul sheet 134 is then placed over core sheet 132 and the entire assembly inserted into mold 136. Mandrel 124 is then expanded so as to prestress core sheet 132. The resulting assembly is then cured to bring the resin matrix to a "B" stage. Upon removal from mold 136, caul sheet 134 is discarded as shown in FIG. 6B. If more strength in the rung attachment area is desired, the material forming side core sections 112 may be thickened or extra layers utilized.

Front slide section 108 and rear slide section 110 are formed in a similar manner without stress rings using an appropriate mandrel. Transfer shaft channel 114 and remote actuator bar channel 116 are formed at the same time front slide section 108 is formed.

Figure 7A:
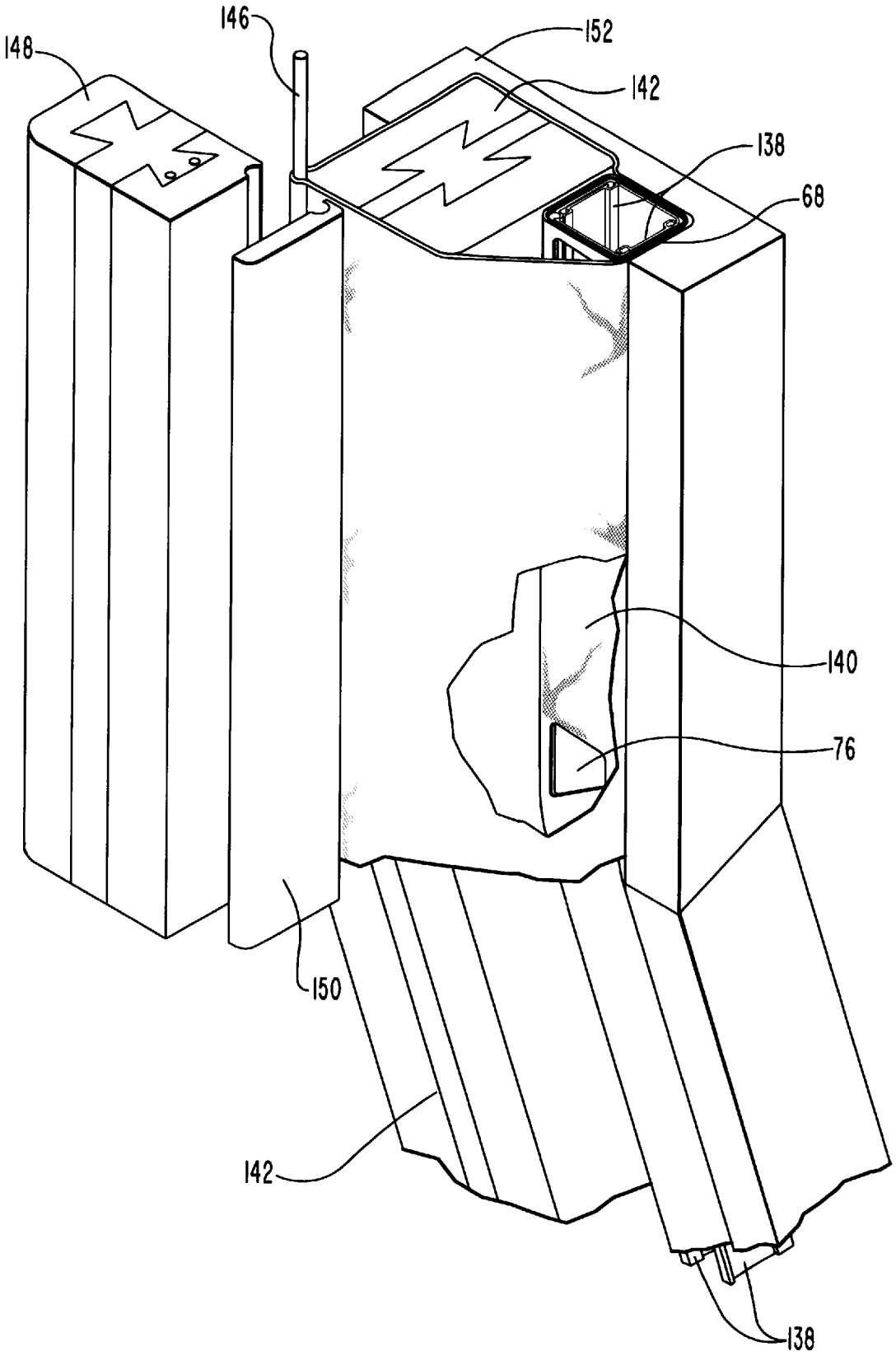
FIG. 7A is a perspective illustration of the method used to construct the outer side rails.

FIG. 7A illustrates a method by which outer side rails 32 may be manufactured within the scope of the present invention. In one preferred embodiment, a multi-section mandrel assembly is employed. Assembly begins by producing outer rail core assembly 68 in a manner similar to that described for inner side rail 34. As illustrated in FIG. 7A, outer rail core assembly 68 comprises a plurality of slide sections 138 which are tapered like front slide section 108 and rear slide section 110 utilized in inner core 50 of inner side rail 34. Outer rail core assembly 68 further comprises two side core sections 140 into which outer rung receiving holes 76 have been formed. In one preferred embodiment, side core sections 140 are flared so that the resulting outer side rail 32 will have a flared bottom portion 40. When side core sections 140 are flared, care must be taken to ensure that outer rung receiving holes 76 on the flared portions are oriented so that all outer rungs will remain parallel.

Mandrel section 142 and mandrel section 144 are attached to outer rail core assembly 68. Resin rod 146 is also temporarily attached to mandrel section 142. Mandrel section 142 is then expanded while mandrel section 144 and outer rail core assembly 68 remain in their unexpanded condition. Mandrel section 142 is mechanically attached to mandrel section 144 during this initial process to afford rigidity to the assembly. Filament 52, impregnated with an appropriate catalyst containing resin, is then wound around the entire assembly of mandrel section 142, mandrel section 144, and the outer rail core assembly 68. Filament 52 is bias wound with respect to the longitudinal access of the assembly so that the resultant fabric has fibers oriented at an angle relative to the longitudinal access of the assembly. Angles of about 15 degrees to about 35 degrees are presently preferred for use in the fiberglass material used in constructing the outer side rails 32. In any event, the angular orientation of the filament with respect to the longitudinal access should not significantly exceed about 45 degrees.

Figure 7B:
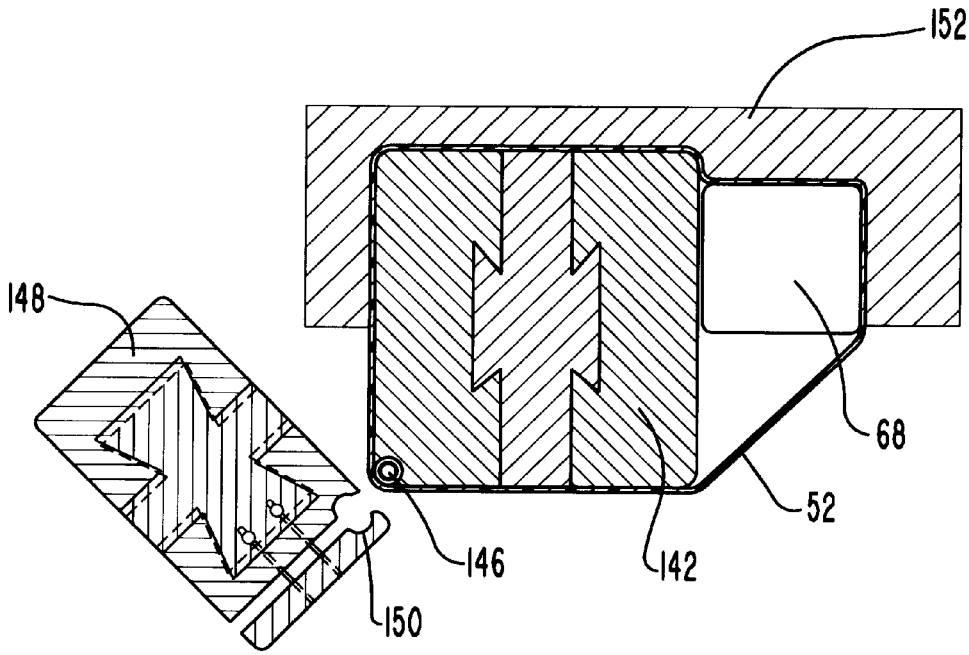
FIG. 7B is an illustration of the method used to construct the outer side rails.
Figure 7C:
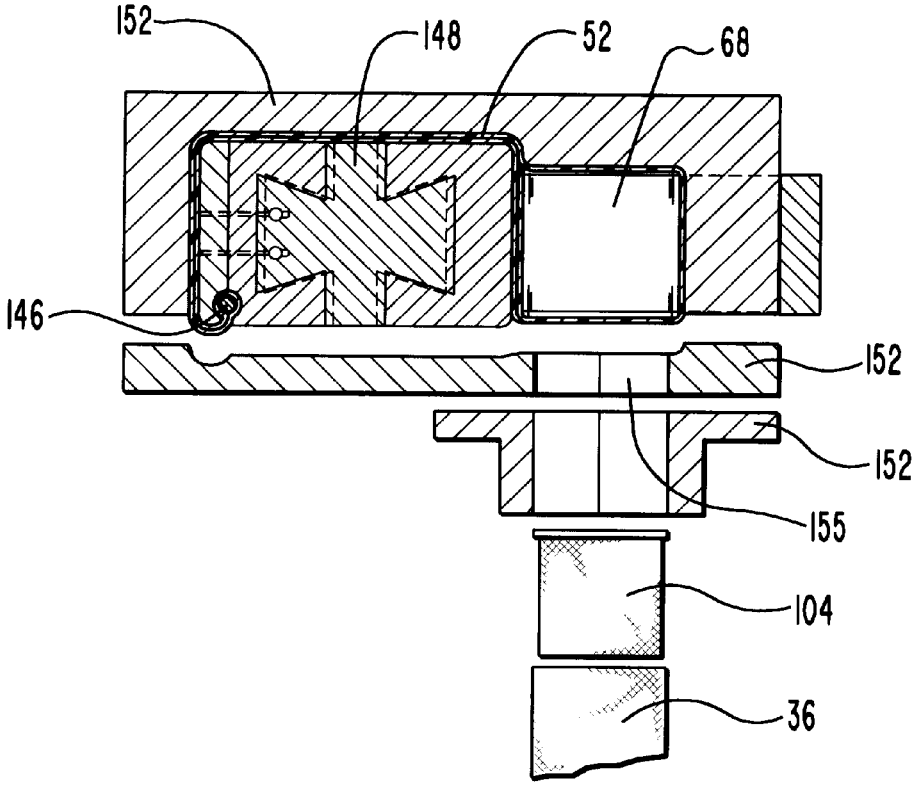
FIG. 7C is an illustration of the method used to construct the outer side rails.

When the desired thickness of filament winding has been deposited on the mandrel assembly, mandrel section 142 is partially relaxed and mandrel section 148 is positioned so that clamp 150 is positioned around resin rod 146. Mandrel section 142 is then relaxed while mandrel section 148 is partially expanded allowing clamp 150 to capture resin rod 146 as shown in FIG. 7B. Mandrel section 142 is then completely withdrawn while simultaneously mandrel section 148 is rotated so that filament 52 is wrapped around the outside of mandrel section 148 as shown in FIG. 7C. The entire assembly now comprising mandrel section 144, mandrel section 148, and outer rail core assembly 68 is then placed within mold 152. Mandrel section 144, mandrel section 148, and outer rail core assembly 68 are then simultaneously expanded to prestress filament 52.

Mold 152 has access holes 155 located where outer rung receiving holes 76 are to be formed within outer side rail 32. The exposed filament 52 visible through access hole is then pierced or cut and folded into outer rung receiving hole 76. In one preferred embodiment, the exposed filament is cut in a roughly "X" shape. Outer rungs 36 and outer rung inserts 104 are placed into the resultant outer rung receiving hole 76. The assembly is then cured. As previously described, if outer rungs 36 are being assembled with both outer side rails 32 in a single step then the entire assembly may be cured to its final state. If, however, only one side rail is to be assembled at a time, care must be taken to cure the assembly only to the "B" state when the rungs are molded into the first outer side rail. When the rungs are subsequently molded into the second outer side rail, then the entire assembly may be brought to its post-cured state.

Figure 8A:
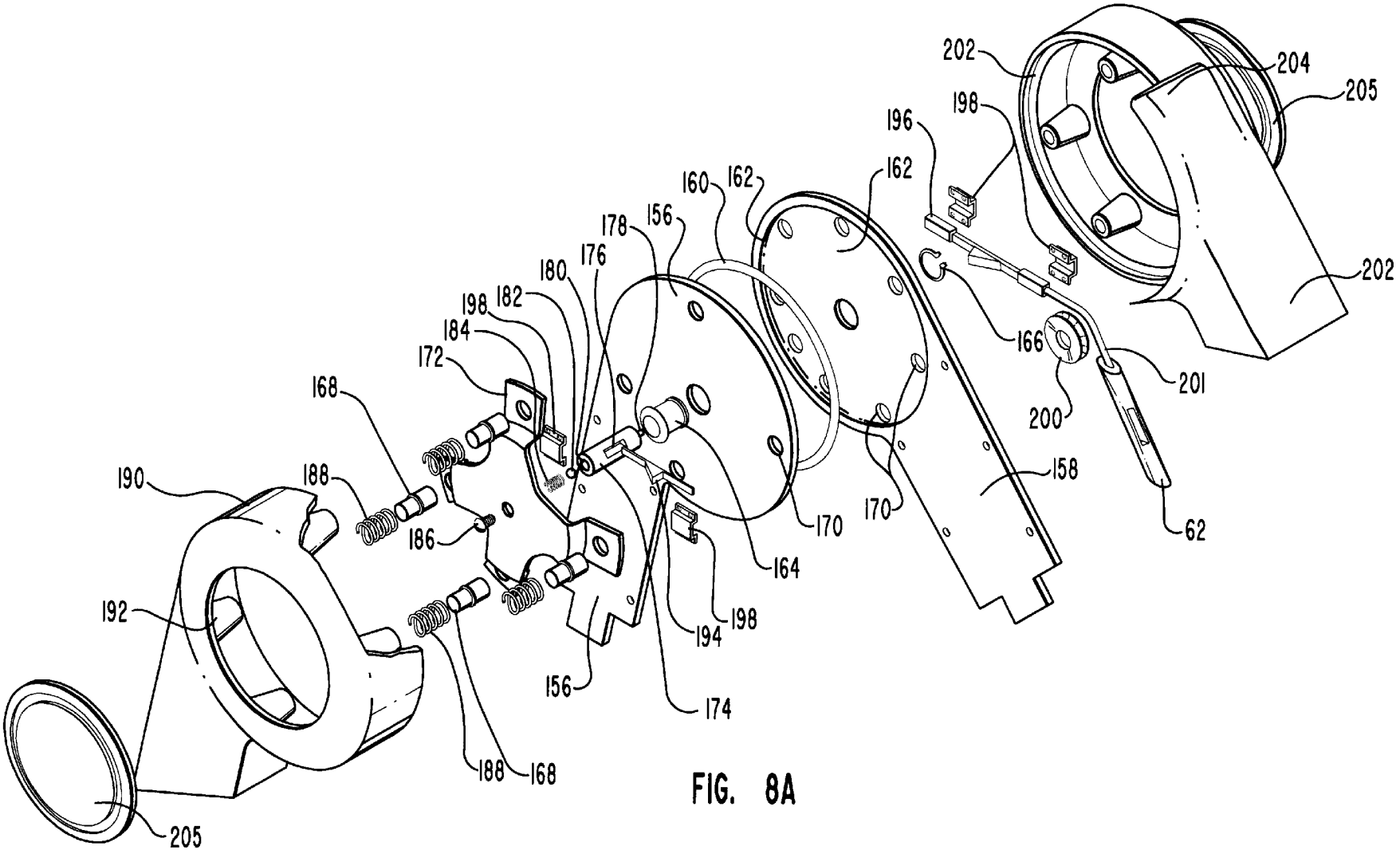
FIG. 8A is an exploded view of one embodiment of the remotely lockable hinge.

FIG. 8A shows an exploded view of one preferred embodiment of remotely lockable hinge 42. In one preferred embodiment, remotely lockable hinge 42 comprises a first extended portion 156 and a second extended portion 158. Located between first extended portion 156 and second extended portion 158 is o-ring 160 which serves to facilitate the relative motion between first extended portion 156 and second extended portion 158. In one preferred embodiment, o-ring 160 is composed of 50% glass filled Teflon and fits smoothly into circular grooves 162 formed within the inner faces of first extended portion 156 and second extended portion 158. In one preferred embodiment first extended portion 156 and second extended portion 158 are retained in close proximity to each other by bushing 164 and snap ring 166.

In one preferred embodiment of remotely lockable hinge 42, indexing means for preventing relative motion between first extended portion 156 and second extended portion 158 is included. In FIG. 8A, the indexing means for preventing relative motion between first extended portion 156 and second extended 158 comprises 1) a plurality of indexing pins 168 capable of extending through indexing holes 170 formed in first extending portion 156 and second extended portion 158, and 2) means for retracting indexing pins 168 from indexing holes 170.

In FIG. 8A, the means for retracting indexing pins 168 from indexing holes 170 comprises separator plate 172 and separator rod 174. In the particular preferred embodiment illustrated in FIG. 8, separator rod 174 has formed therethrough slot 176. At one end of separator rod 174 is stem 178 and at the other end of separator rod 174 is threaded hole 180.

Threaded hole 180 is bored with a tool having a radial tip thereby creating a semispherical bottom to the hole. Threaded hole 180 intersects slot 176 so as to allow the spherical tip to only partially penetrate into slot 176. Hole 180 is then threaded so as to be capable of receiving a screw.

Separator plate 172 is attached to separator rod 174 by first inserting bearing 182 into threaded hole 180. Bearing 182 is sized so as to not interfere with threaded hole 180 and to only partially extend through the semi-spherical bottom of hole 180. Spring 184 is inserted into threaded hole 180 and separator plate 172 is attached to separator rod 174 by screw 186 or other equivalent attachment mechanism. The resultant assembly will retract indexing pins 168 from indexing holes 170 when a force is applied to separator rod 174.

In the particular preferred embodiment shown in FIG. 8A indexing pins 168 are mechanically biased against separator plate 172 by a plurality of indexing springs 188. Hinge cover 190 has formed therein indexing hubs 192 of sufficient diameter and depth so as to receive indexing springs 188 and indexing pins 168. Indexing hubs 192 must be of sufficient depth to allow retraction of indexing pins 168 into indexing hubs 192 when a force is applied to separator rod 174 which causes separator plate 172 to retract indexing pins 168 into indexing hubs 192.

Remote operation of the embodiment of remotely lockable hinge 42 shown in FIG. 8A is accomplished through a first taper slide 194 and a second taper slide 196. First taper slide 194 passes through slot 176 and second taper slide 196 interfaces with stem 178. When first taper slide 194 is pulled through slot 176 indexing pins 168 are retracted from indexing holes 170 by separator plate 172. Similarly, when second taper slide 196 is pulled past stem 178, indexing pins 168 are retracted from indexing holes 170 by separator plate 172.

First taper slide 194 is mounted on the back of first extended portion 156 by taper slide channels 198. Second taper slide 196 is mounted to the back of second extended portion 158 by taper slide channels 198. First taper slide 194 and second taper slide 196 are attached remote actuator bars 62 via wire 201 which is placed over pulley 200. When the respective remote actuator bar 62 is moved downwardly, first taper slide 194 or second taper slide 196 is pulled past separator rod 174 and indexing pins 168 are retracted from indexing holes 170 by separator plate 172.

First extended portion 156 is fixedly attached to hinge cover 190 and extended portion 158 is fixedly attached to hinge cover 202. Hinge cover 190 and hinge cover 202 are also provided with hinge stop 204. The purpose of hinge stop 204 is to prevent remotely lockable hinge 42 from being extended past its 180 degree locked position.

Figure 8B:
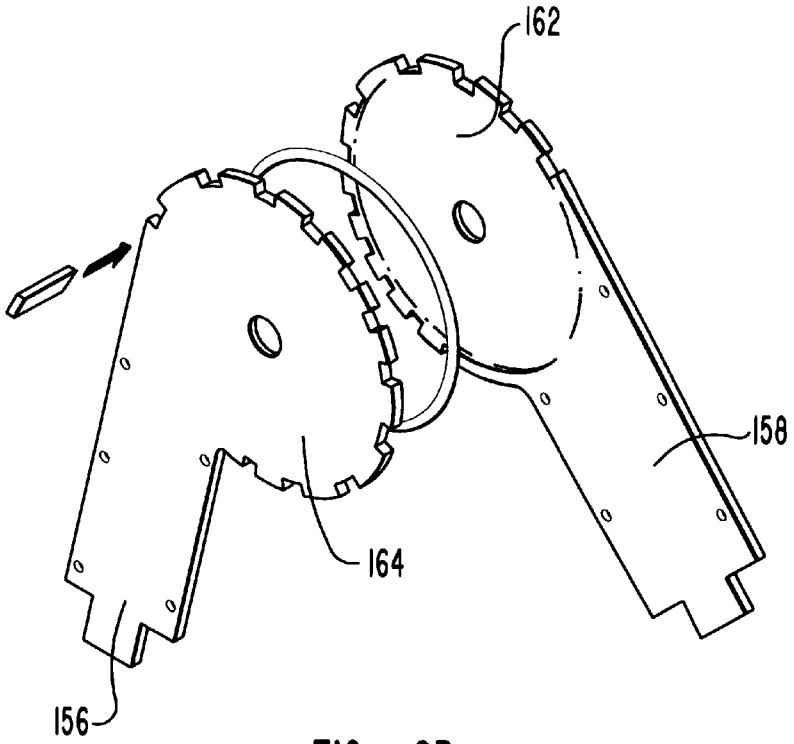
FIG. 8B is a portion of an alternate embodiment of the remotely lockable hinge.
Figure 8C:
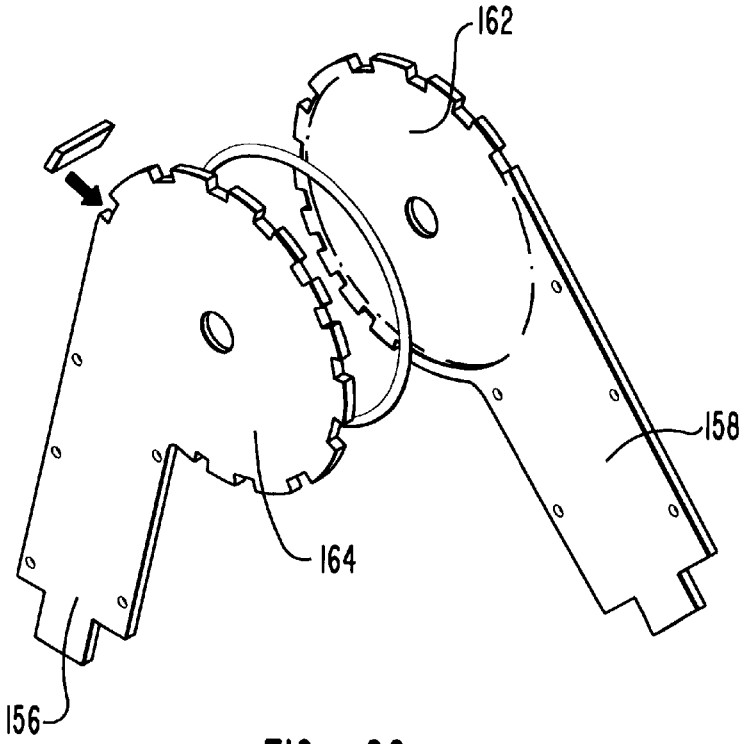
FIG. 8C is a portion of another alternate embodiment of the remotely lockable hinge.

Other embodiments of remotely lockable hinge 42 are possible. For example, indexing means for preventing relative motion between first extended portion 156 and second extended portion 158 may comprise a plurality of indexing bars 206 which engage a plurality of indexing slots 208 located around the periphery of first extended portion 156 and second extended portion 158 as illustrated in FIG. 8B. Indexing bars 206 may be configured so as to slide out of indexing slots 204 in a manner similar to indexing pins 168 or they may be made to retract radially from indexing slots 204 as shown in FIG. 8C. All that is required for construction of remotely lockable hinge 42 is that motion from remote actuator bar 62 is translated through an appropriate mechanism to the indexing means for preventing relative motion between first extended portion 156 and second extended portion 158.

Figure 17:
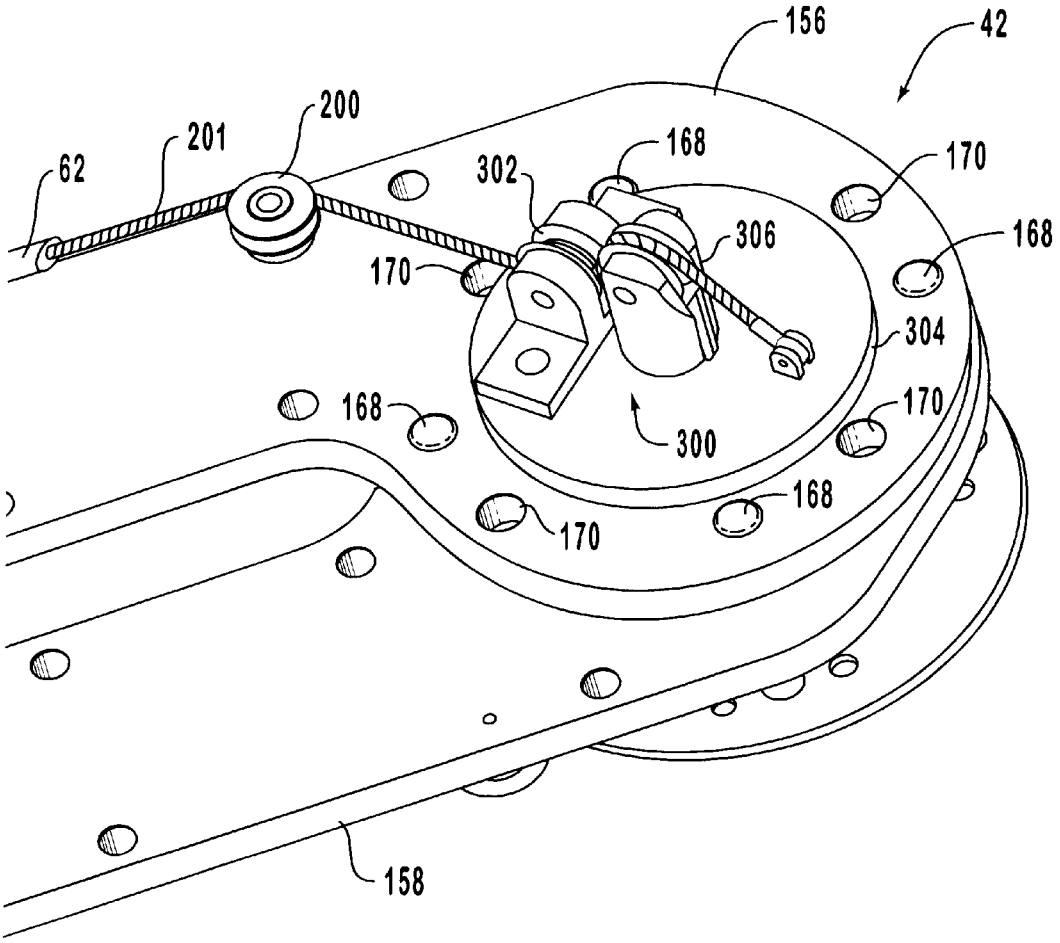
FIG. 17 is a perspective view of another embodiment of the remotely lockable hinge.
Figure 17A:
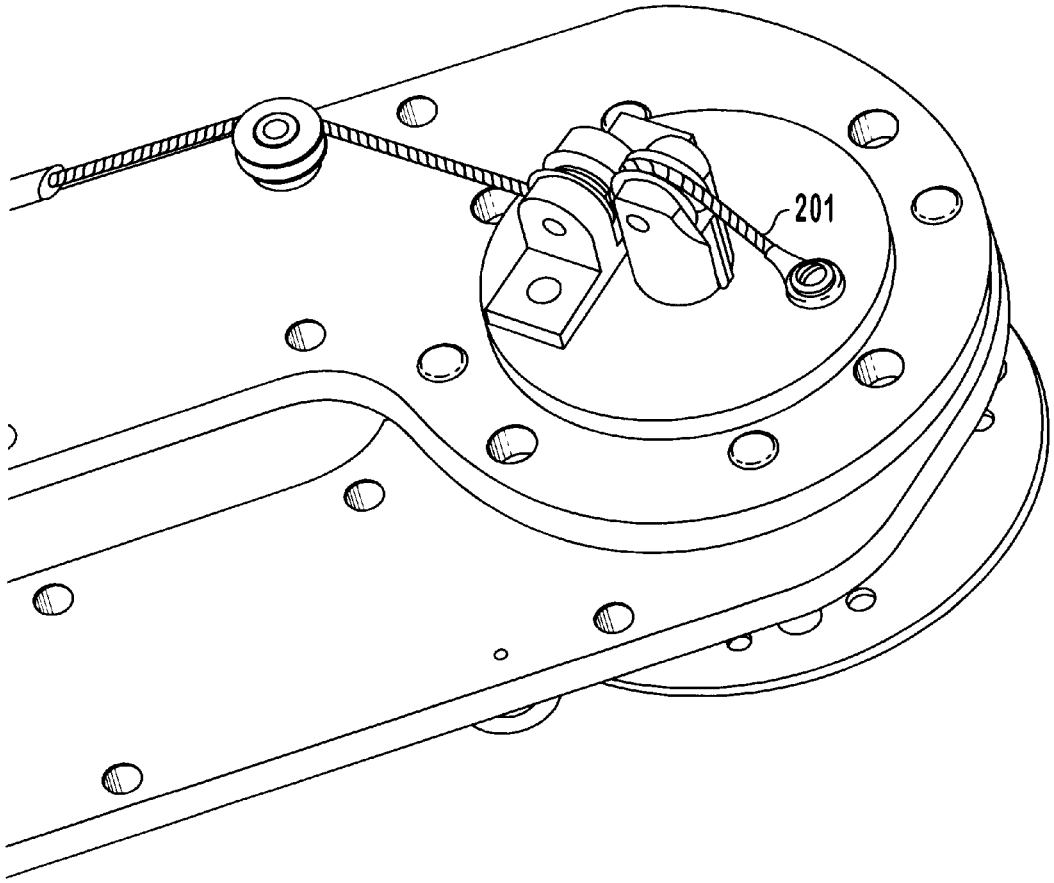
FIG. 17A is a portion of an alternate embodiment of the remotely lockable hinge of FIG. 17.

As another example, with reference to FIG. 17, indexing means for preventing relative motion between the first extended portion 156 and the second extended portion 158 can still be accomplished by indexing pins 168 positioned within indexing holes 170 while other means provide for the removal of the pins from the holes so that relative motion between the first and second extended portions can occur. One such means comprises a pair of offset pulleys 300 having one offset pulley thereof 302 being affixed on a plate 304 while the second offset pulley thereof 306 is inserted through the plate 304. The cable wire 201 attached to the remote actuator 62 is wound under the one offset pulley 302 and over the other offset pulley 306 so that when the remote actuator 62 for the hinge is pulled, the cable wire 201 tends to straighten out and the one offset pulley 302 and the plate 304 is forced up and away into the separator plate 172 (FIG. 8A). In this manner, the separator plate 172 causes indexing pins 168 to be retracted from the indexing holes 170 and relative motion between the first and second extended portions is allowed to occur. It should be appreciated that by this embodiment, a similar set of offset pulleys and plate is arranged on the second extended portion 158 to allow similar operation when a separate remote actuator is actuated. Thus, the ladder is provided with at least four locations where remote actuators can facilitate relative motion between the extended portions of the remotely locking hinge 42. With reference to FIG. 17A an alternate embodiment of fastening wire cable 201 to plate 304 is depicted.

Assembly of remotely lockable hinge 42 may be accomplished as follows. Indexing springs 188 are inserted into indexing hubs 192 located in hinge cover 190. Indexing pins 168 are also placed within indexing hubs 192.

Bushing 164 is inserted into first extended portion 156.

Separated plate 172 is attached to separator rod 174 by first inserting bearing 182 into threaded hole 180. Spring 184 is inserted into threaded hole 180 and separator plate 172 is attached to separator rod 174 by screw 186 or other equivalent attachment mechanism. The resultant separator plate assembly is inserted into bushing 164.

First taper slide 194 is attached to the back of first extended portion 156 by taper slide channel 198 so as to extend through slot 176 of separator rod 174. Pulley 200 is also attached to the back of first extended portion 156 and wire 201 is placed over pulley 200. First extended portion 156 is then fixedly attached to hinge cover so that indexing pins 168 extend through separator plate 172 and indexing holes 170 formed in first extended portion 156.

Second taper slide 196 attached to the back of second extended portion 158 by taper slide channels 198. Pulley 200 is attached to the back of second extended portion 158 and wire 201 is placed over pulley 200. Second extended portion 158 is then fixedly attached to hinge cover 202. The resultant second extended portion assembly is then placed over the first extended portion assembly so that bushing 164 extends through second extended portion 158. Bushing 164 is then locked in place with snap ring 166. As will be evident, assembly of this embodiment of remotely lockable hinge 42 requires, at a minimum, an access hole in hinge cover 202 so that snap ring 166 may be locked around bushing 164. This access hole may then be covered with an appropriate access hole cover 205. Access hole cover 205 may be embossed or otherwise include a logo or similar item.

Materials used in the manufacture of remotely lockable hinge 42 may vary considerably according to the intended application of the hinge. For example, if the remotely lockable hinge 42 is going to be used for abnormally high stress loads a tough chrome or nickel alloy steel may be preferred in the fabrication of first extended portion 156 and second extended portion 158. If remotely lockable hinge 42 is to be used in extremely humid conditions, a non-corrosive, tough alloy such as 440C stainless may be preferred. If a toy replica or a demonstration model is desired, many of the parts may be made of plastic. However, the preferred materials possessing the best general properties include a heat-treatable alloy steel for extended portion 156, extended portion 158, bushing 164, bearing 182, separator rod 174, and indexing pins 168. A light weight but ridged material such as 7075-T651 aluminum is preferred for separator plate 172. First taper slide 194 and second taper slide 196 and associated taper slide channels 198 are preferably made from a smooth grained, non-corrosive alloy. Hinge covers 190 and 202 may be manufactured from a variety of materials, both metal and synthetic. The preferred compound however is fifty percent nylon impregnated polyester. Remote actuator bar 62 should be non-electrically conductive and should slide freely within remote actuator bar channel 116. A fiberglass rod using a polyester system is presently preferred.

Figure 9:
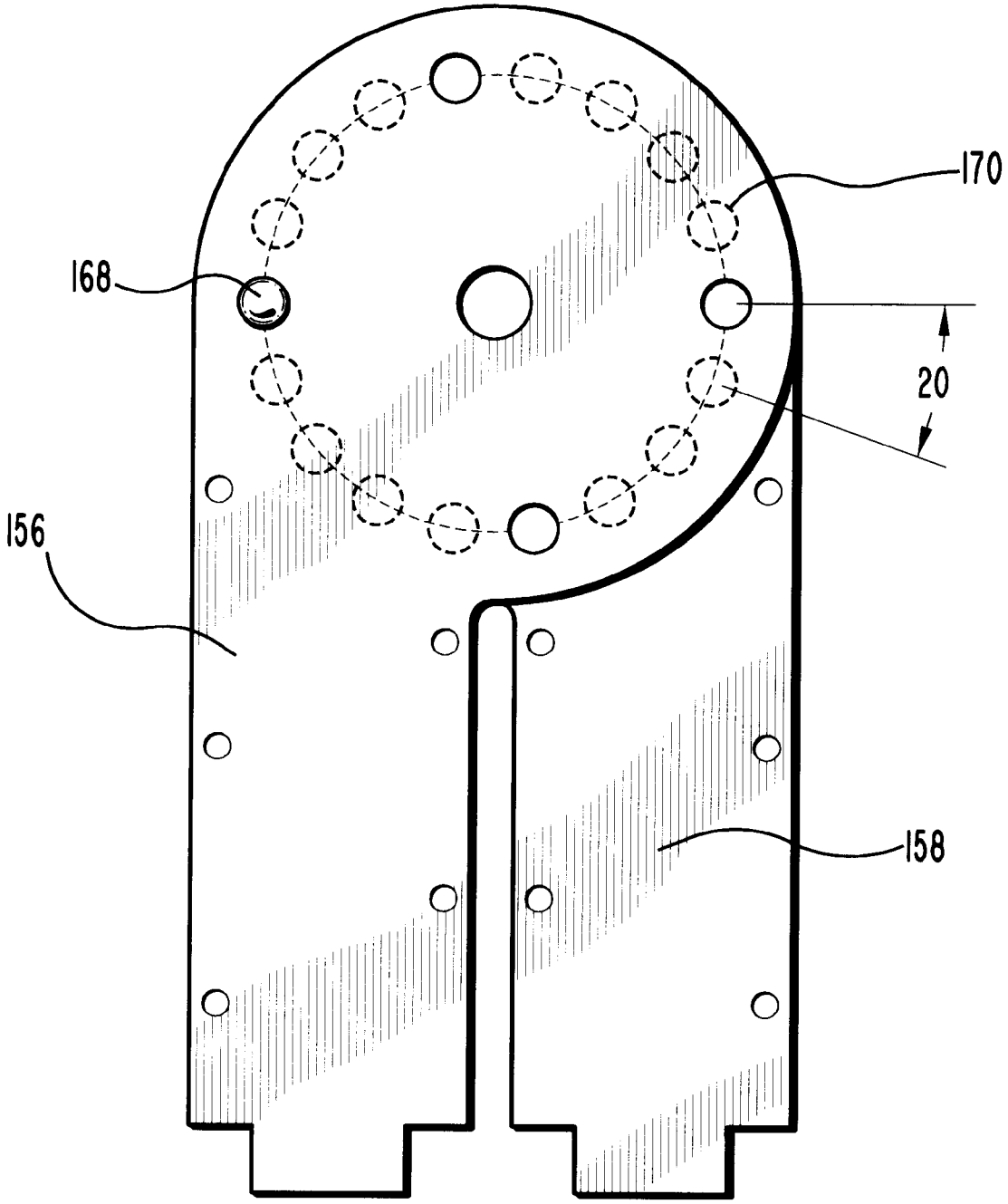
FIG. 9 illustrates one embodiment of the locking positions of the remotely lockable hinge.

Remotely lockable hinge 42 may be manufactured so as to lock in any number of fixed positions. In one preferred embodiment, remotely lockable hinge 42 is manufactured so as to lock when the relative angles of first extended portion 56 and second extended portion 58 are between about 0 degrees and 180 degrees in 20 degree steps. This is accomplished as shown in FIG. 9 by drilling indexing holes 170 in second extended portion 158 in 20 degree spacings. This allows indexing pins 168 which extend through indexing holes 170 located in first extended portion 156 to extend into indexing holes 170 located in second extended portion 158 when the angle between first extended portion 156 and second extended portion 158 is a multiple of 20 degrees.

Figure 10A:
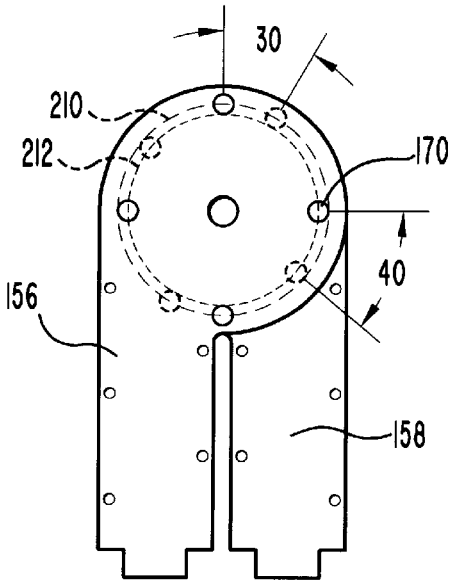
FIG. 10A is an illustration of the locking positions of one embodiment of the remotely lockable hinge.
Figure 10B:
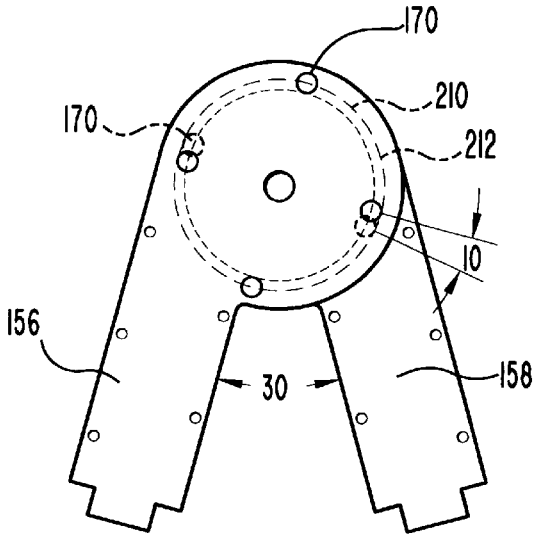
FIG. 10B is an illustration of another locking position of one embodiment of the remotely lockable hinge.
Figure 10C:
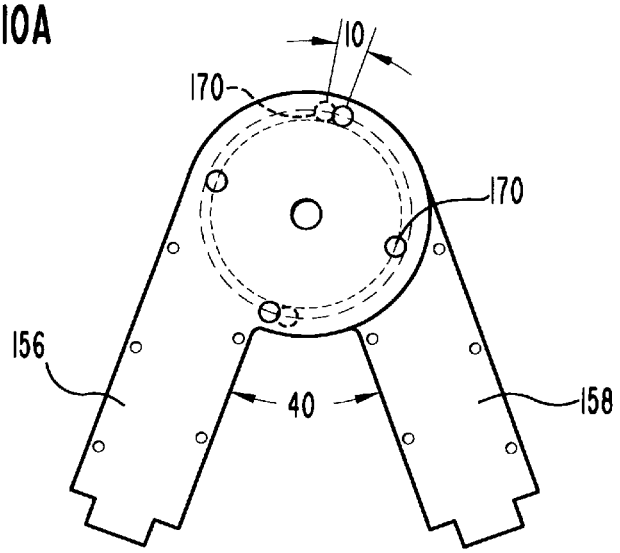
FIG. 10C is an illustration of another locking position of one embodiment of the remotely lockable hinge.
Figure 10D:
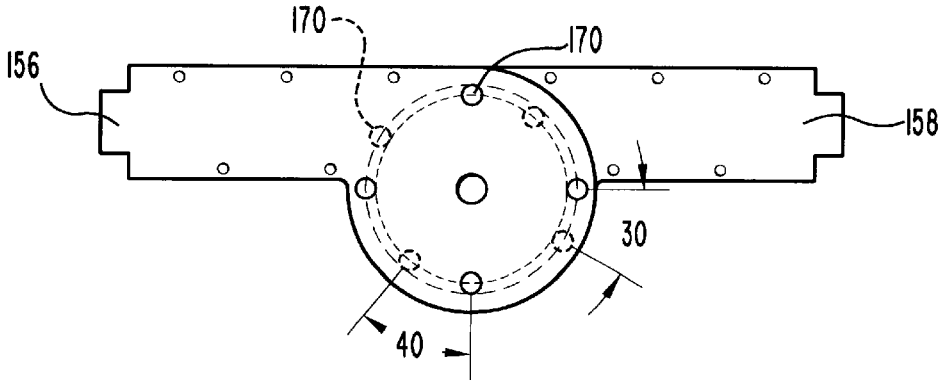
Figure 10D is an illustration of yet another locking position of one embodiment of the remotely lockable hinge.

In another preferred embodiment, remotely lockable hinge 42 is manufactured in order to lock when the relative angle between first second portion 156 and second portion 158 is 0 degrees, 30 degrees, 40 degrees or 180 degrees. How this is accomplished is depicted in FIG. 10. As shown in FIG. 10A, first extended portion 156 and second portion 158 lock when the angle between them is 0 degrees. As demonstrated in FIG. 10A indexing pins 168 and indexing holes 170 are located on two circles of differing radii. As viewed in FIG. 10A the top and bottom indexing pins are located on an outer circle 210 and the left and right indexing pins are located on an inner circle 212. These four locations represent indexing holes drilled in both first extended portion 156 and second extended portion 158.

As demonstrated in FIG. 10A second extended portion 158 also has two indexing holes 170 located 30 degrees from the top and bottom indexing holes 170. These holes are drilled along outer circle 210. Finally, second extended portion 158 has two indexing holes 170 located 40 degrees from the left and right indexing hole. These holes are drilled at a radius corresponding to inner circle 212. With the indexing holes drilled in these locations, remotely lockable hinge 42 will lock at 0 degrees, 30 degrees, 40 degrees and 180 degrees, as demonstrated in FIGS. 10A through 10D. Note that all four indexing pins 168 extend through first extended portion 156 and second portion 158 when the relative angle between the two extended portions is either 0 degrees or 180 degrees. When the angle between first extended portion 156 and second extended portion 158 is 30 degrees or 40 degrees, only two indexing pins 168 extend through first extended portion 156 and second extended portion 158.

Figure 11A:
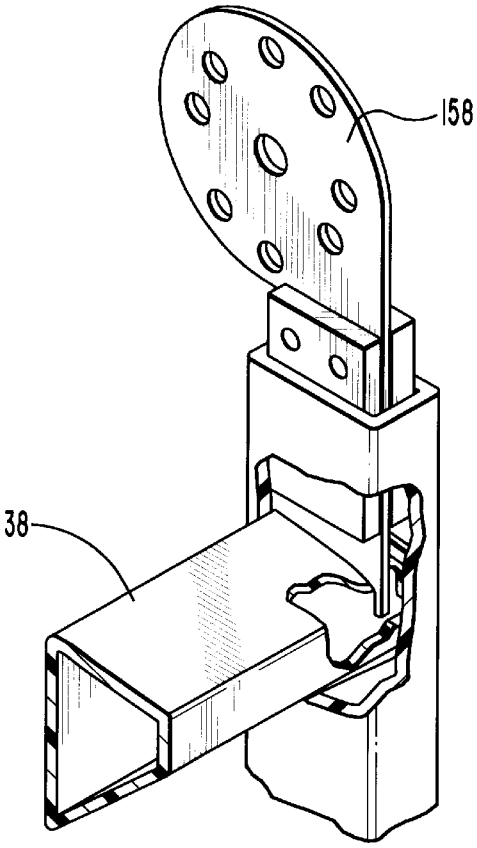
FIG. 11A is an illustration of one method used to attach the remotely lockable hinge to the ladder.

Of central importance is how remotely lockable hinge 42 is tied into outer side rail 32. One preferred embodiment is shown in FIG. 11A. In this preferred embodiment, first extended portion 156 and second extended portion 158 are contoured so as to partially wrap around the top most inner rung 38. As first extended portion 156 or second extended portion 158 is inserted into the hollow interior of inner side rail 34, the contour of the extended portion will wrap around top most inner rung 38. In this manner, the extended portion of remotely lockable hinge 42 is tied into both inner side rail 34 and inner rung 38.

Figure 11B:
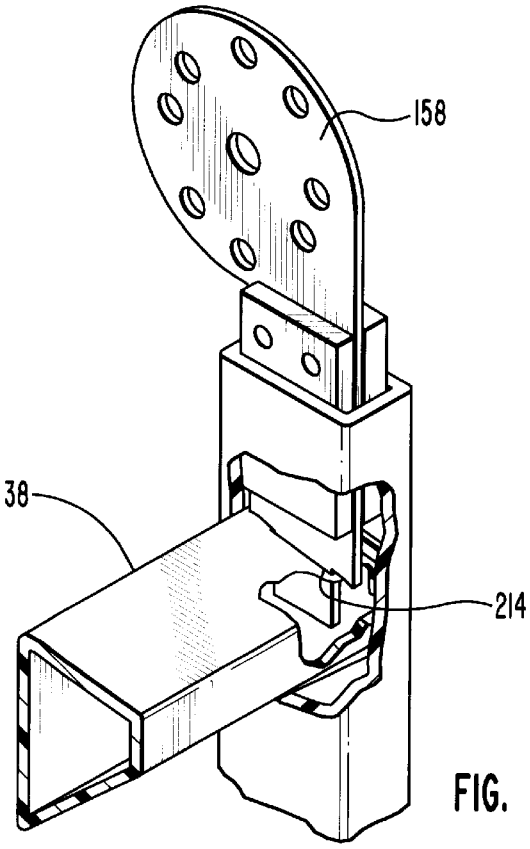
Figure 11B is an illustration of another method used to attach the remotely lockable hinge to the ladder.

In one preferred embodiment, means for transmitting loads exerted on remotely lockable hinge 42 to inner side rail 34 is included. In FIG. 11B the means for transmitting loads comprises hinge slot 214 formed in top most inner rung 38. The bottom of first extended portion 156 and second extended portion 158 is then shaped so as to extend into hinge slot 214. Inner rung insert 102 (not shown) helps distributes the force exerted by first extended portion 156 or second extended portion 158 to the entire inner rung 38. Additionally, transfer rod 58 and inner side rail 34 help to distribute all load forces into the fabric of side rail 34 and to the remaining inner rungs 38. As a result, the torsion load factors exerted upon inner side rail 34 at the point where it interfaces with first extended portion 156 or second extended portion 158 are converted to stress loads and distributed over a large portion of the entire inner side rail fabric.

Figure 12:
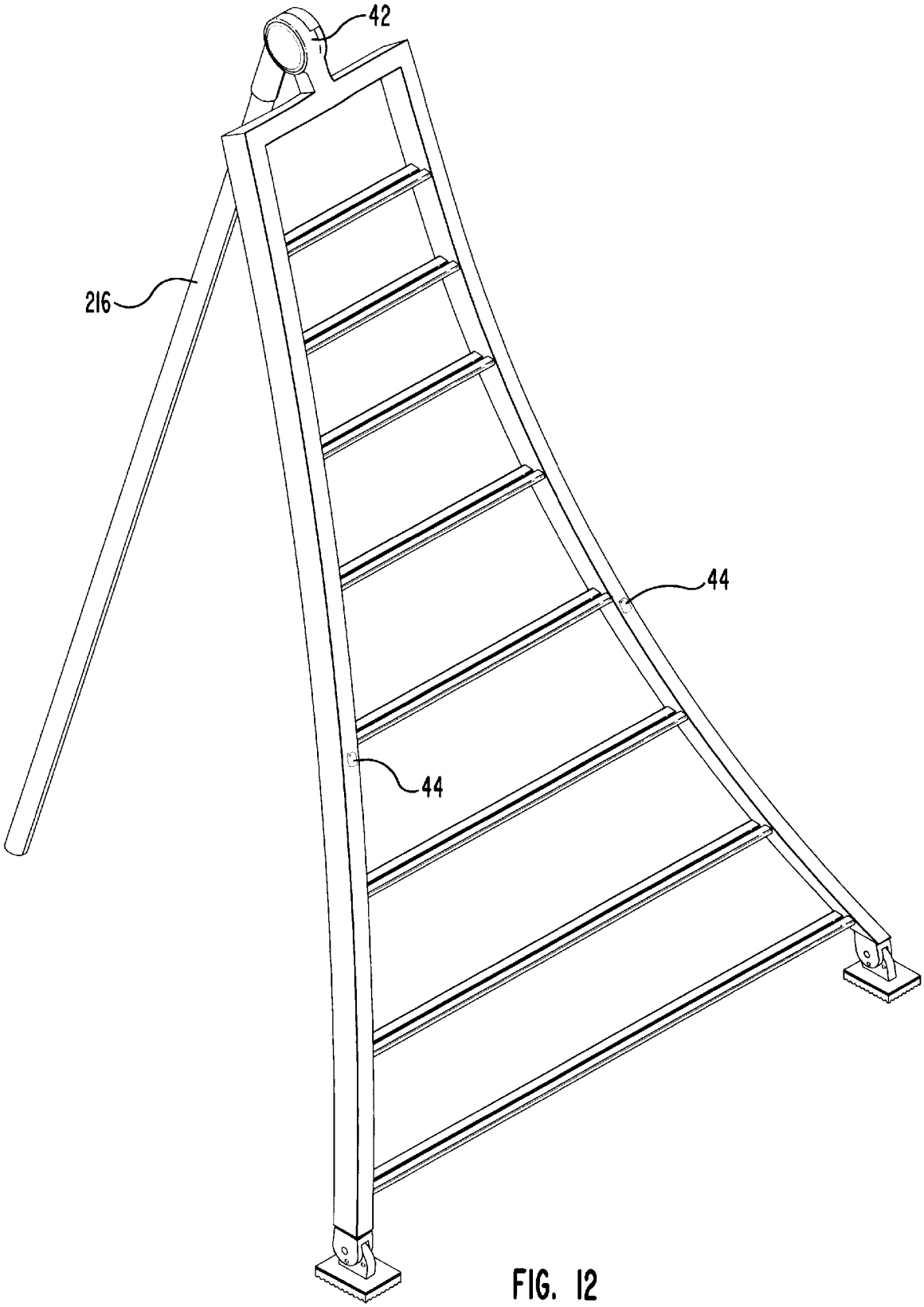
FIG. 12 is an alternate embodiment of a ladder employing a remotely operated hinge within the scope of the present invention.

As will be appreciated, use of remotely lockable hinge 42 is not limited to a combination step and extension ladder. Such a hinge may be utilized in any ladder where the hinge is located out of a user's reach and yet the characteristics of locking are desired. For example, FIG. 12 depicts an alternate embodiment where remotely lockable hinge 42 is utilized on a non-extendable step ladder with one or more stabilizing legs 216. It will also be appreciated, that use of remotely lockable hinge 42 is not limited to ladders constructed of composite material. Remotely lockable hinge 42 may be utilized with ladders manufactured from any conventional materials such as metal, wood, or plastic. Such a hinge may also be utilized in other applications such as collapsible scaffolding or other situations where a hinge is placed out of a user's reach.

Figure 13A:
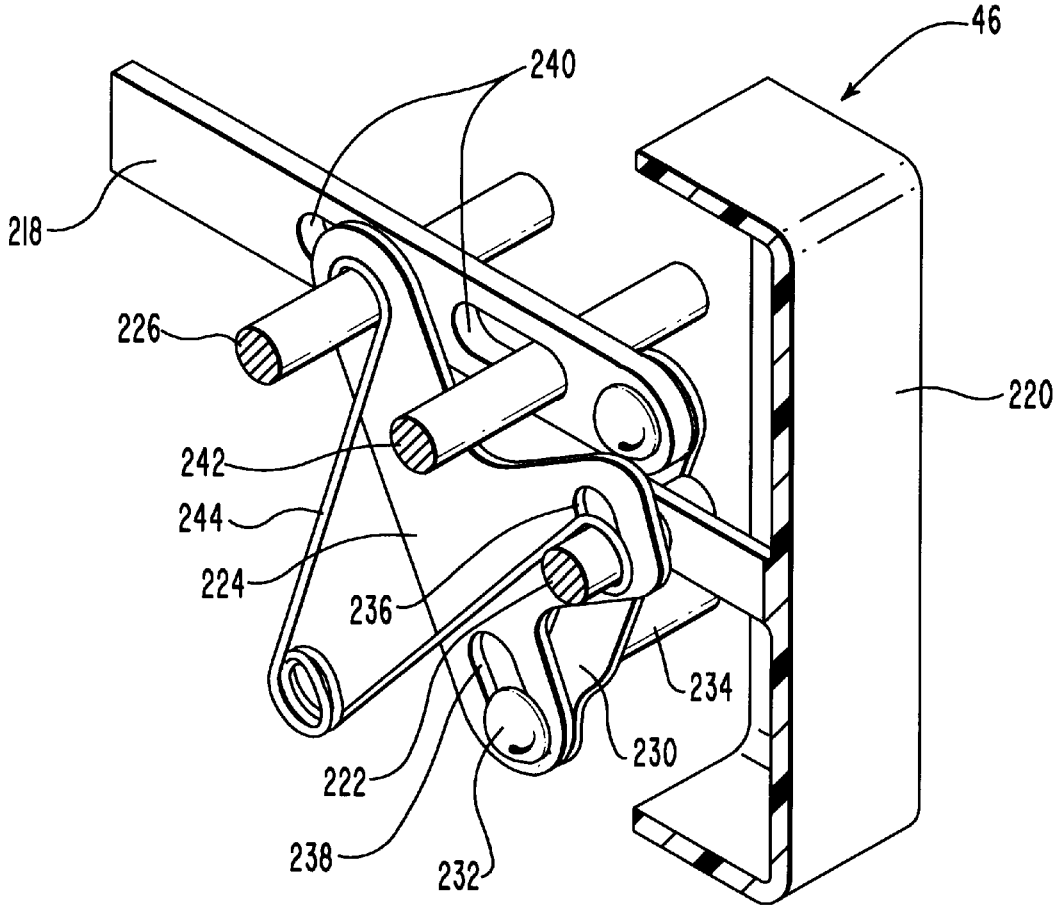
FIG. 13A is a perspective illustration of the locking mechanism used in a preferred embodiment of the present invention.
Figure 13B:
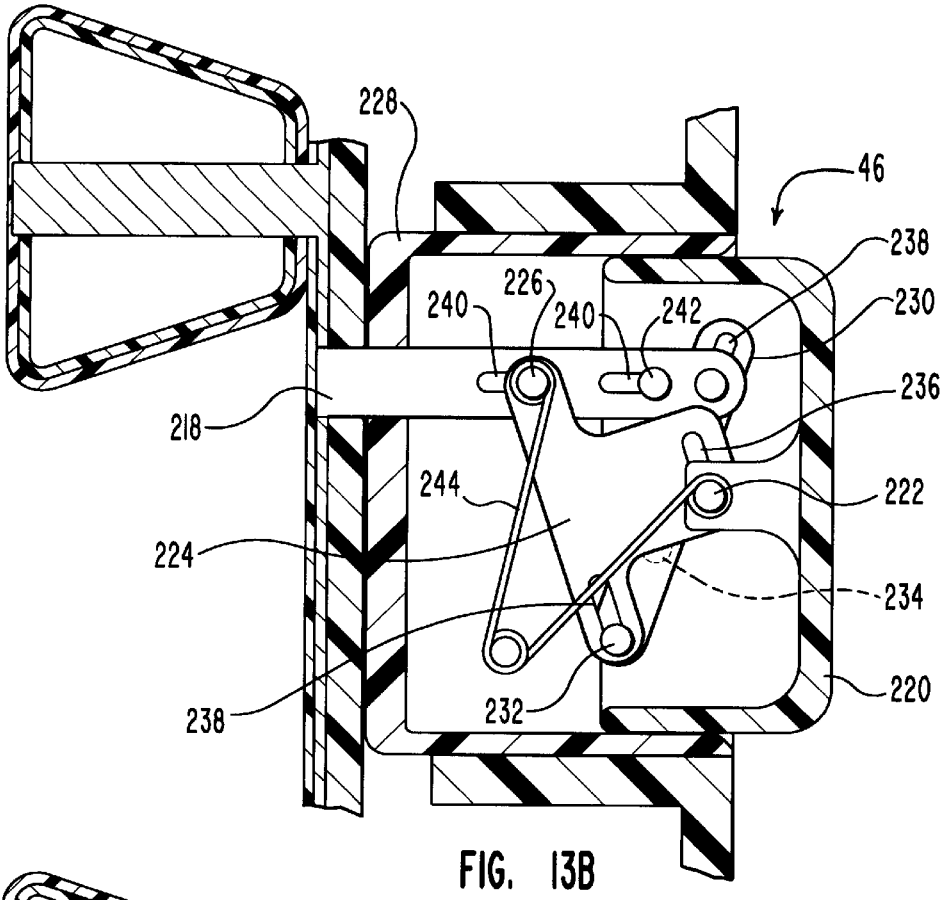
FIG. 13B is a cross section of the locking mechanism used in a preferred embodiment of the present invention.
Figure 13C:
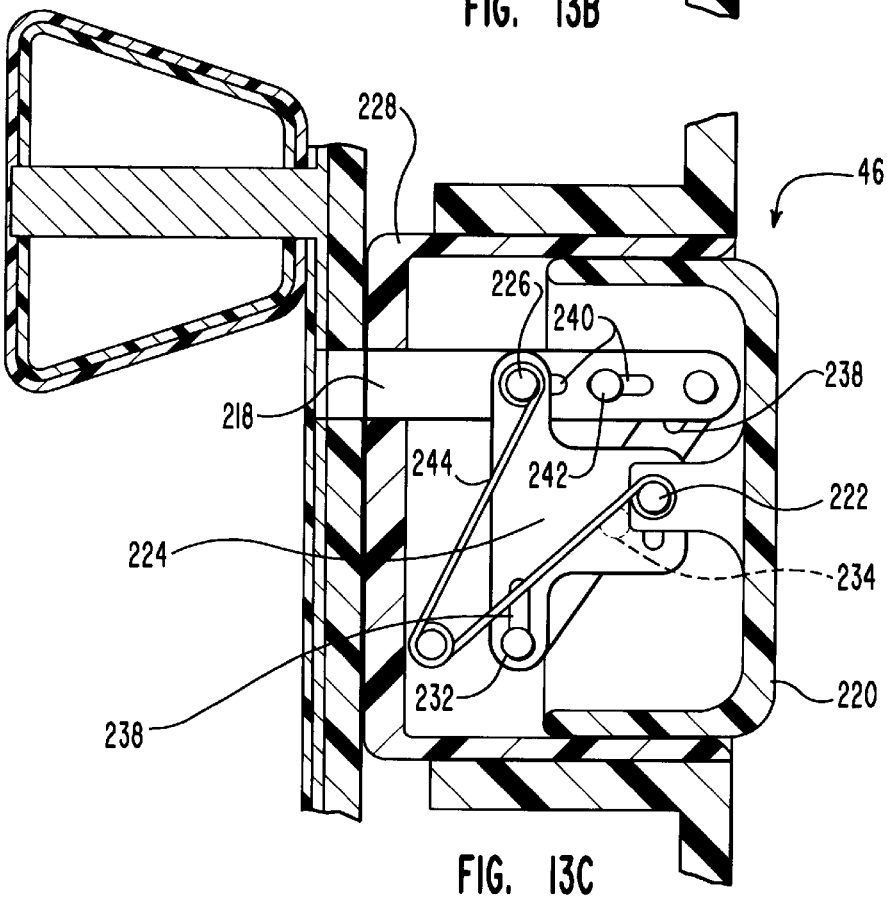
FIG. 13C is a cross section of the locking mechanism used in a preferred embodiment of the present invention.

One preferred embodiment of ladders within the scope of the invention comprises means for locking inner side rails 34 at a fixed telescopic location relative to outer side rails 32. In one preferred embodiment, the means for locking inner side rails 34 and a fixed telescopic location relative to outer side rails 32 comprises an actuator mechanism shown generally as 46 with a retractable actuator shaft 218 as shown in FIGS. 13A–13C. FIG. 13A is a perspective view while 13B and 13C are cross-sectional views. As actuator button 220 is depressed, pin 222 transfers the motion to pivot arm 224. As pivot arm 224 moves inward it pivots about pivot rod 226 which is stationary with respect to actuator housing 228. The inward motion of pivot arm 224 is transferred to pivot linkage 230 through rivet 232. Pivot linkage 230 pivots about pivot shaft 234 which is stationary with respect to actuator housing 228. Pivot linkage 230 reverses the direction of motion and transfers this motion to actuator shaft 218. Hence, when actuator button 220 is depressed, actuator shaft 218 is retracted. FIG. 13C shows actuator mechanism 46 in the depressed position.

Pivot arm slot 236 enables actuator button 220 to move linearly inward when depressed while pivot arm 224 moves radially. Displacement slots 238 allow for the linear displacement of connecting rivets with respect to the radial movement of pivot arm 224 and pivot linkage 230. Actuator slots 240 slide over support rod 242 and pivot rod 226 to allow actuator shaft 218 to move horizontally but inhibit any vertical movement or tension. In this manner, actuator shaft 218 remains aligned with actuator holes 48 located in inner side rail 34.

Return spring 244 is attached to pivot rod 226 and pin 222. Return spring 244 is designed so as to resist the inner motion of pin 222 and, therefore, returns actuator button 220 to its relaxed state when released. As actuator button 220 is released, all motion described above is reversed and actuator shaft 218 advances through actuator hole 48. By keeping actuator button 220 depressed, the user may skip over as many extension positions as desired. To lock inner side rails 34 in position relative to outer side rails 32 the user has only to release actuator button 220 just prior to reaching the location desired. When aligned, actuator shaft 218 will automatically lock into place.

Figure 18:
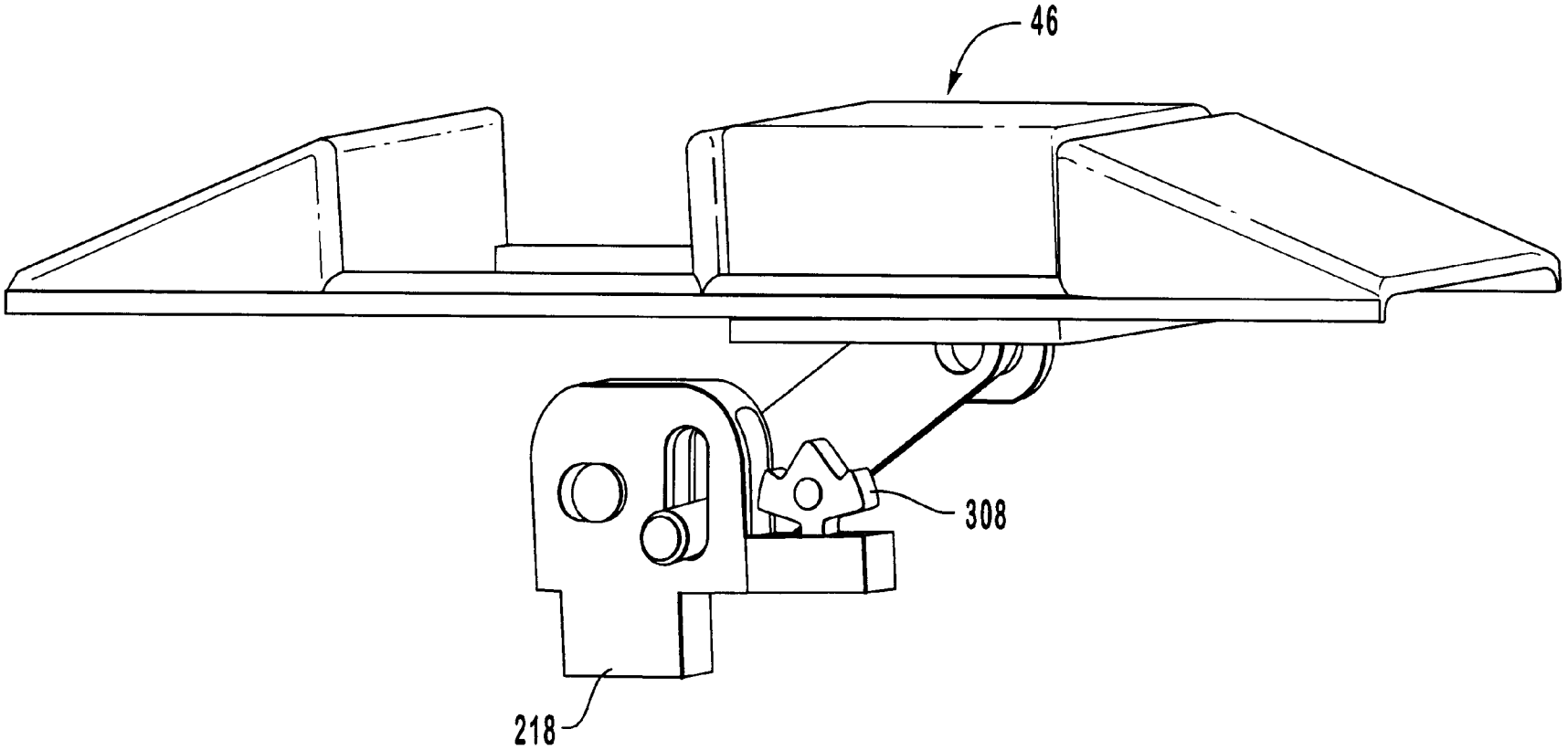
FIG. 18 is a perspective view of an alternate embodiment of a remote rail actuator in the non-actuated position.
Figure 19:
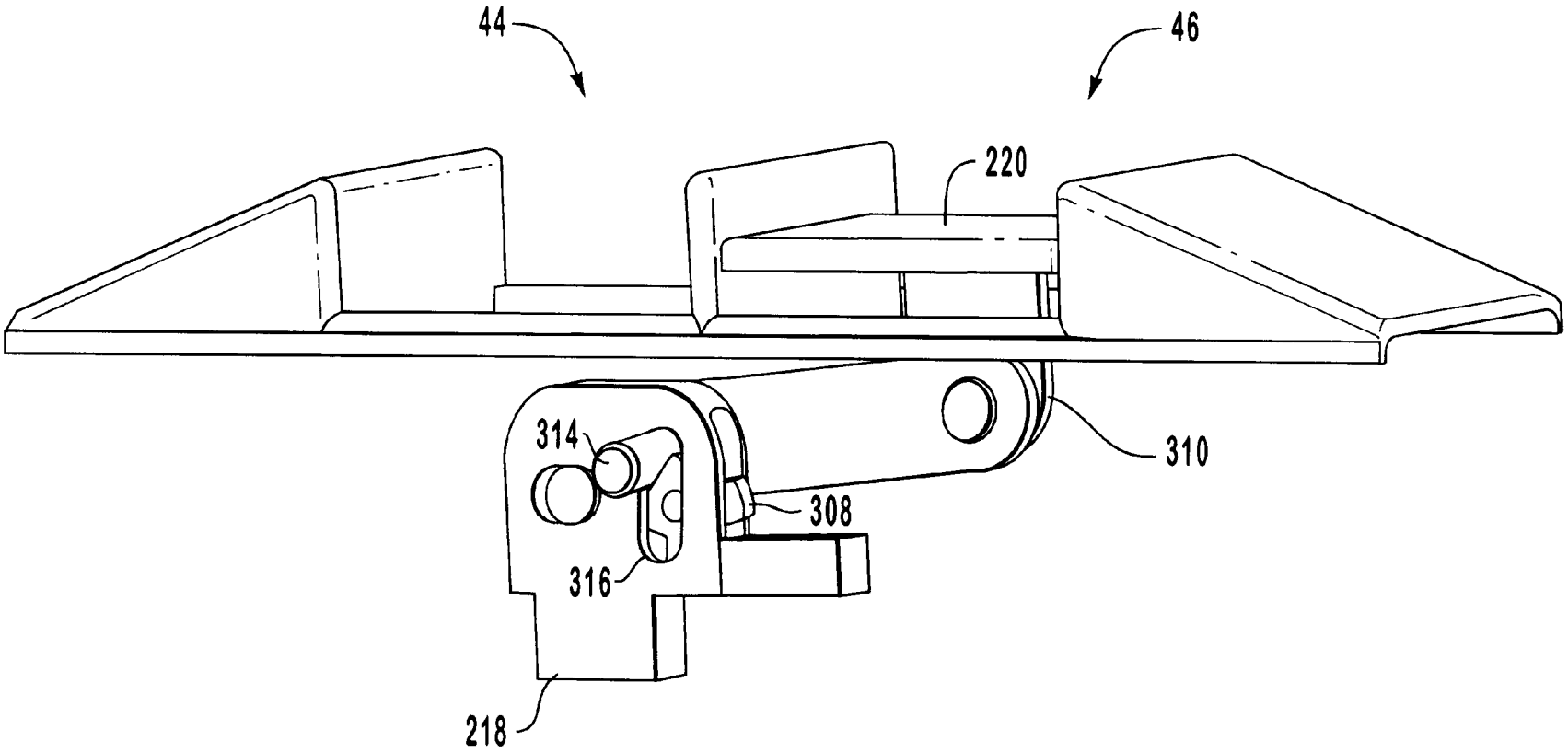
FIG. 19 is a perspective view of the remote rail actuator of FIG. 18 in an actuated position.

With reference to FIGS. 18 and 19, an alternative embodiment is depicted for locking the inner side rails 34 in a fixed telescopic location relative to the outer side rails 32. In this embodiment, however, an intermittent stop device 308 is provided for temporarily preventing actuation of the inner side rails once the rail actuator mechanism is actuated. This facilitates single-handed user operation of adjusting both the telescopic location and the overall height of the ladder. As before, the actuator mechanism is shown generally as 46 and is mechanically connected to the retractable actuator shaft 218 which is then operationally engaged with the inner side rail 34. In FIG. 18, the intermittent stop device 308 is depicted in the non-actuated position. With reference to FIG. 19, as the actuator button 220 is depressed, linkage 310 is correspondingly depressed causing pivot arm 312 to rotate clockwise. As pivot arm 312 rotates, a connector arm 314 attached to the pivot arm 312 is caused to slide upward within a vertical slot 316. In response to the connector arm sliding upward, the actuator shaft 218 is correspondingly caused to move upward towards the actuator mechanism. The intermittent stop device 308, which is biased to move leftward into the vertical slot 316, is now able to move into the slot because the connector arm which was preventing such movement in the non-actuated position is no longer able to prevent the movement. In this position, the intermittent stop device 308 prevents the actuator shaft from engaging the inner pair of side rails and the user is then able to actuate the three other rail actuator mechanisms, for example. When the actuator device is actuated a second time, the mechanical linkages cause the reverse motion to occur to return the intermittent stop device to the non-actuated position. It should be appreciated that in this embodiment the actuator mechanism 46 for the rail is arranged in a side-by-side configuration with the remote hinge actuator 44 as opposed to a top-to-bottom configuration.

In one preferred embodiment remotely lockable hinge 42 comprises indexing means for preventing relative motion between the first and second extended portions and means for remotely operating the indexing means. In FIGS. 14A–14D, the means for remotely operating the indexing means comprises a remote actuator shown generally as 44 having a remote actuator shaft 246. In one preferred embodiment, remote actuator 44 is designed to cause remote actuator shaft 246 to engage remote actuator bar holes 64 formed in remote 16 actuator bar 62 and to cause remote actuator bar 62 to move in a generally downward direction. The generally downward direction of remote actuator bar 62 is transmitted to remotely lockable hinge 42 and causes remotely lockable hinge 42 to become unlocked.

Figure 14A:
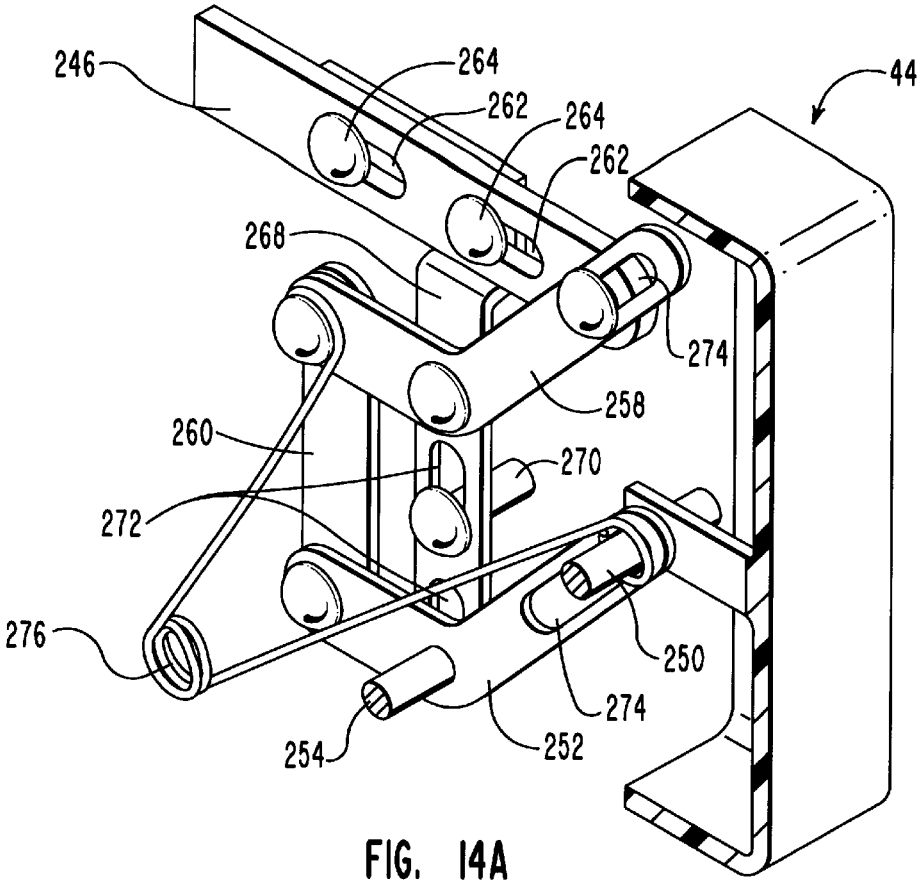
FIG. 14A is a perspective illustration of a remote actuator used with a preferred embodiment of the present invention.
Figure 14B:
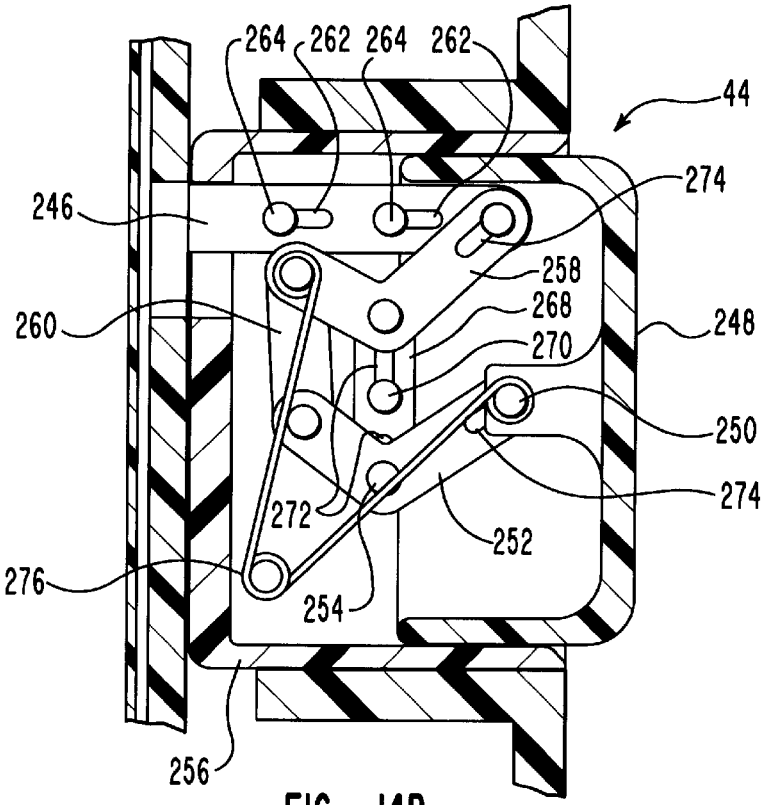
FIG. 14B is a cross section of a remote actuator used in a preferred embodiment of the present invention.
Figure 14C:
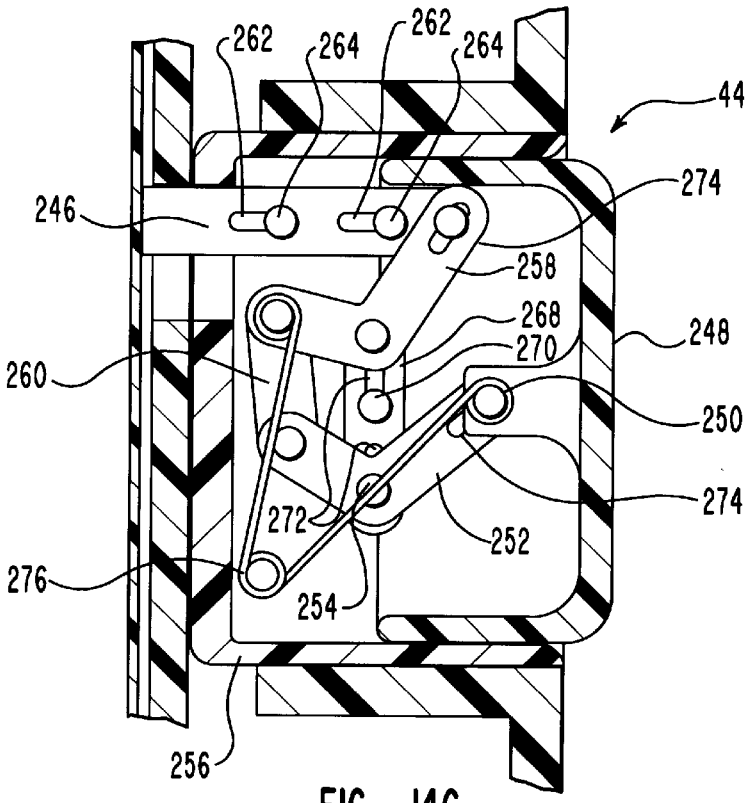
FIG. 14C is a cross section of a remote actuator used in a preferred embodiment of the present invention.

Remote actuator 44 shown in FIGS. 14A–14D is designed to cause remote actuator shaft 246 to move first in an inward direction so as to engage remote actuator bar hole 64 located in remote actuator bar 62. After engagement of remote actuator bar hole 64 remote actuator shaft then proceeds in a downward direction and imparts a downward motion to remote actuator bar 62. This sequence is shown in FIG. 14A through 14C.

In FIGS. 14A–14D, as remote actuator button 248 is pressed inward, motion is directed to pin 250 which drives lower pivot arm 252 inward. Lower pivot arm 252 rotates about pivot rod 254 which remains stationary with respect to remote actuator housing 256. This motion is directed to upper pivot arm 258 through pivot linkage 260. Upper pivot arm 258 then drives remote actuator shaft 246 forward which causes it to engage remote actuator bar holes 64. This is shown in FIG. 14C.

Figure 14D:
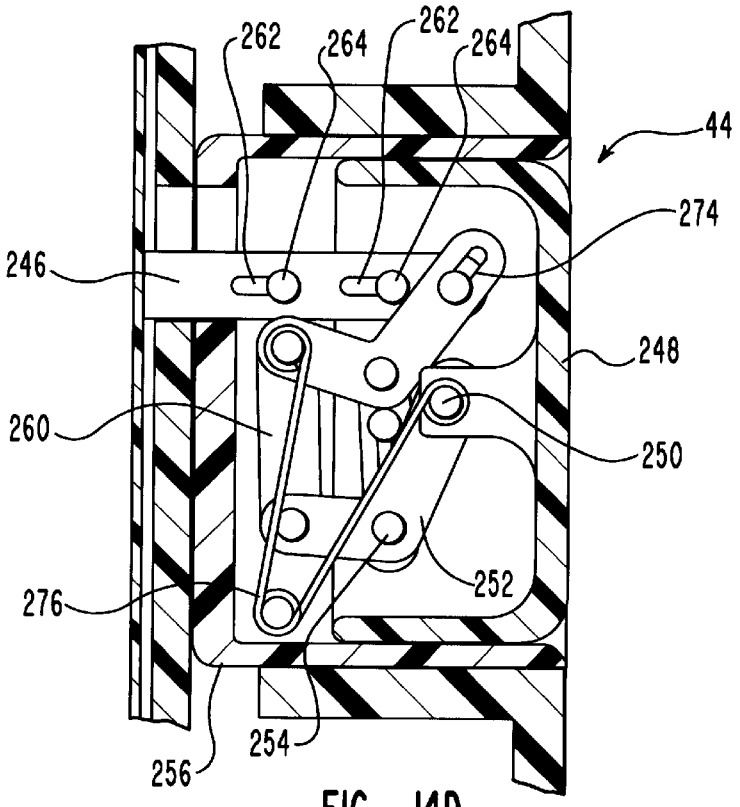
FIG. 14D is a cross section of a remote actuator used in a preferred embodiment of the present invention.

When remote actuator shaft 246 has moved inwardly to the point when remote actuator slots 262 reach rivets 264 inner movement of remote actuator shaft 246 stops. Further depression of remote actuator button 248 continues to direct its motion through lower pivot arm 252. This motion is converted by lower pivot arm 252 into a downward motion on upper pivot arm 258 through pivot linkage 260. Because upper pivot arm 258 is inhibited from transferring this motion to remote actuator shaft 246, the motion is instead directed to tandem slide 268 which is pulled downward. This motion is transferred to remote actuator shaft 246 which also moves downward. Thus, remote actuator shaft 246 is first moved inward to engage remote actuator bar hole 64 and then move downward to exert a generally downward force on remote actuator bar 62. This is shown in FIG. 14D.

Figure 15A:
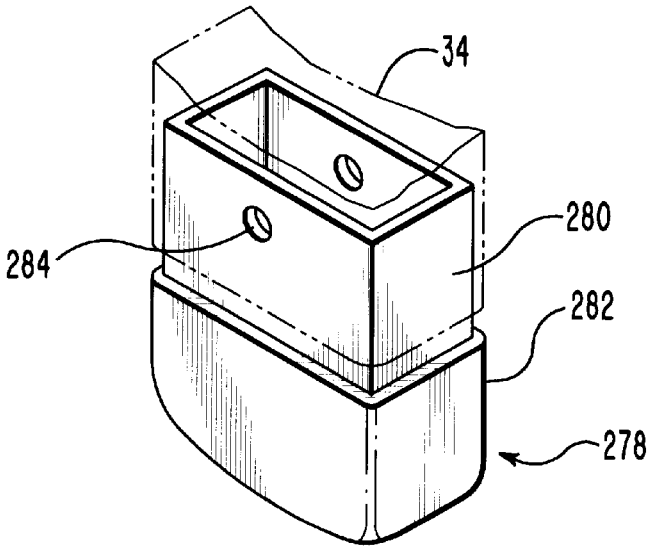
FIG. 15A is an illustration of the inner rail-shoe assemblies utilized in a preferred embodiment of the present invention.
Figure 15B:
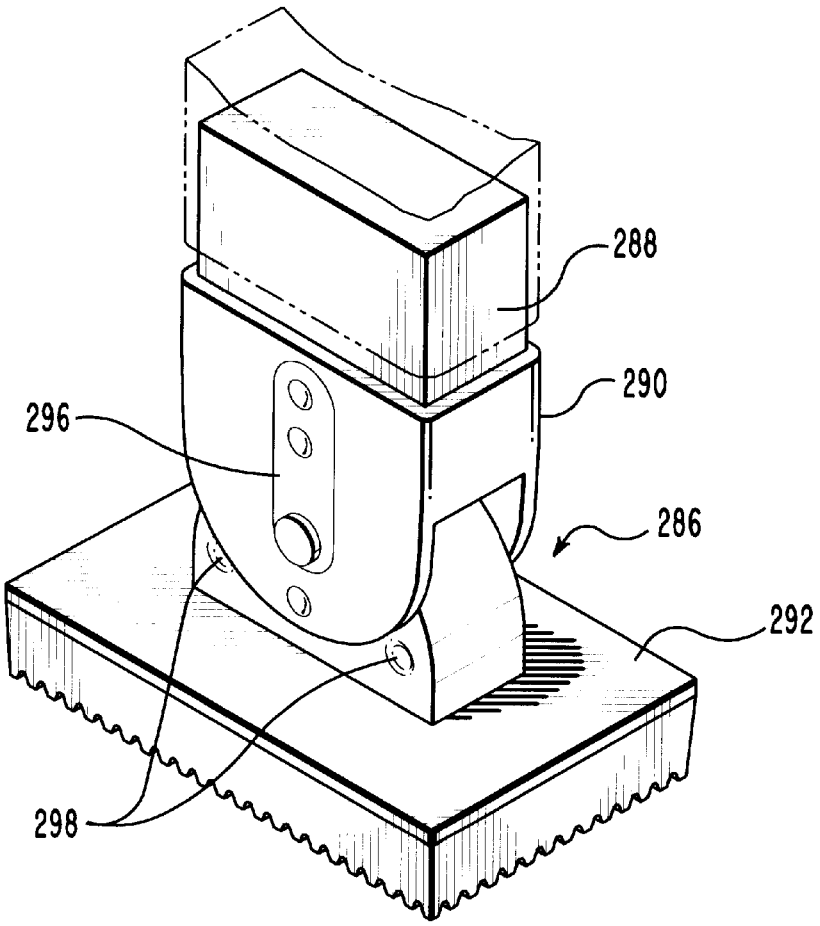
FIG. 15B is an illustration of the outer rail-shoe assemblies utilized in a preferred embodiment of the present invention.

Pivot rod 254 and support pin 270 are stationary with respect to remote actuator housing 256. Slots 272 allow tandem slide 268 to move downward. Pivot arm slots 274 allow for the differences between linear and radial displacement within the actuator assembly. Return spring 276 not only returns remote actuator assembly 44 to its original position, but also inhibits the downward motion of tandem slide 268 until remote actuator shaft 246 has reached its maximum inner stroke. This action, therefore, sets a priority of inner motion of actuator shaft 246 over vertical motion of tandem slide 268. Rail shoes such as those illustrated in FIGS. 15A and 15B, are commonly used in the production of ladders. Inner rail shoe 278 shown in FIG. 15A may be made of many materials, but the currently preferred embodiment is an injection molded elastomeric material. Shank 280 has external dimensions coinciding with the inner surface of inner side rail 34. Pad section 282 has external dimensions which coincide with the outer dimensions of inner side rail 34. The elastomeric material provides an excellent shock absorbing surface for inner side rail 34. Treads may be added to the bottom of pad surface 282 to reduce the probability of slippage. Inner rail shoe 278 may be attached to inner side rails 34 through any means which will provide a permanent attachment. In FIG. 15A, inner rail shoe 278 is provided with hole 284 through which a rivet or other permanent attachment device may be placed. Additionally, inner rail shoe 278 may be press-fit into inner side rail 34.

Outer side rails 32 may be provided with outer rail shoes. FIG. 15B shows one preferred embodiment of an outer rail shoe shown generally as 286. Shank 288 has an outside dimension coinciding with the inner dimension of the outer side rail 32. In one preferred embodiment clevis section 290 is pivotally attached to base section 292.

Outer rail shoe 286 may be provided with means to selectively retain base section 292 at predetermined angles. In FIG. 15B the means to retain base section 292 at predetermined angles comprises indexing spring 296 located on clevis section 290 and detents 298 located on base section 292. Indexing spring 296 is designed to engage detents 298 as base section 292 is pivoted relative to clevis section 290.

With reference to the remaining Figures, ladder accessories are provided that facilitate stability and convenient use during operation thereof. Yet it should be appreciated that the following accessories are not to be construed as limited to use with the ladder configuration herein described. These accessories are equally applicable to any ladder such as wooden, plastic, metal, or other fiberglass based ladders. It is even contemplated within the scope of this invention that the following accessories are appropriate for use with scaffolding apparatus or any other user lifting arrangements requiring stability.

Figure 20:
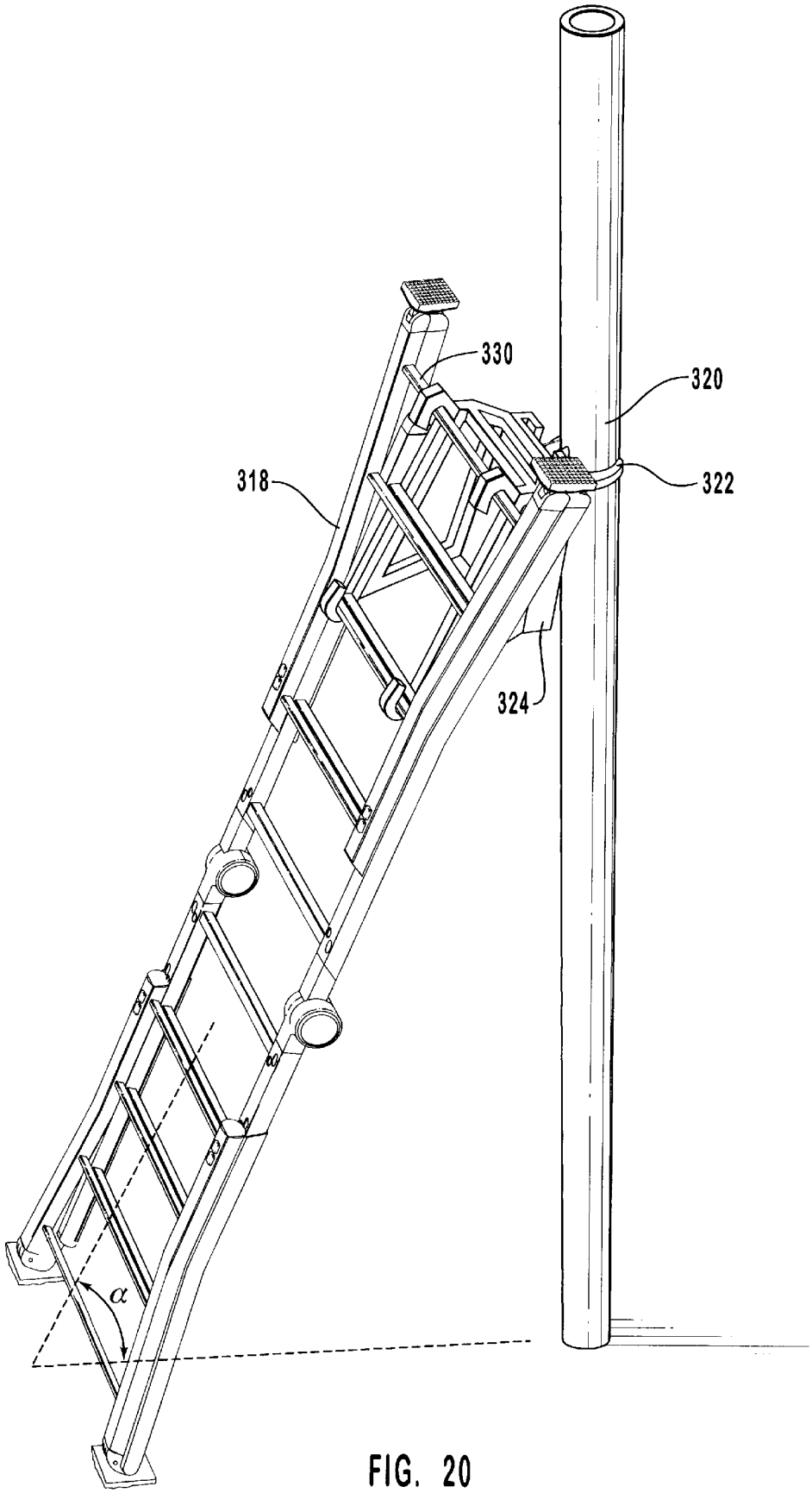
FIG. 20 is a perspective view of an exemplary ladder and a stabilizer device accessory facilitating ladder stability against a curved surface during operational use.

With particular reference to FIG. 20, an exemplary configuration of a ladder stabilized against a surface in accordance with the present invention is illustrated by a ladder 318 positioned against a curved surface 320 in the form of a pole. The ladder 318, positioned against the curved surface at ladder angle a, is stabilized by means of a stabilizer device 322 securely fastened about the curved surface. Although the stabilizer device is herein depicted as a pole caliper, other embodiments of the stabilizer device will be described. It will be appreciated that beyond the stabilizer devices taught herein, still other embodiments exist for use with various other surfaces and that the following particular embodiments should be construed as representative and not restrictive. In this embodiment, the stabilizer device is releasably mounted to an attachment frame 324 which is releasably mounted to the ladder 318. Advantageously, releasable mounting facilitates convenience as a user adjusts between ladders, as a user adjusts between various stabilizer devices or as the ladder is adjusted between operational use with a stabilizer device and without one.

Figure 21:
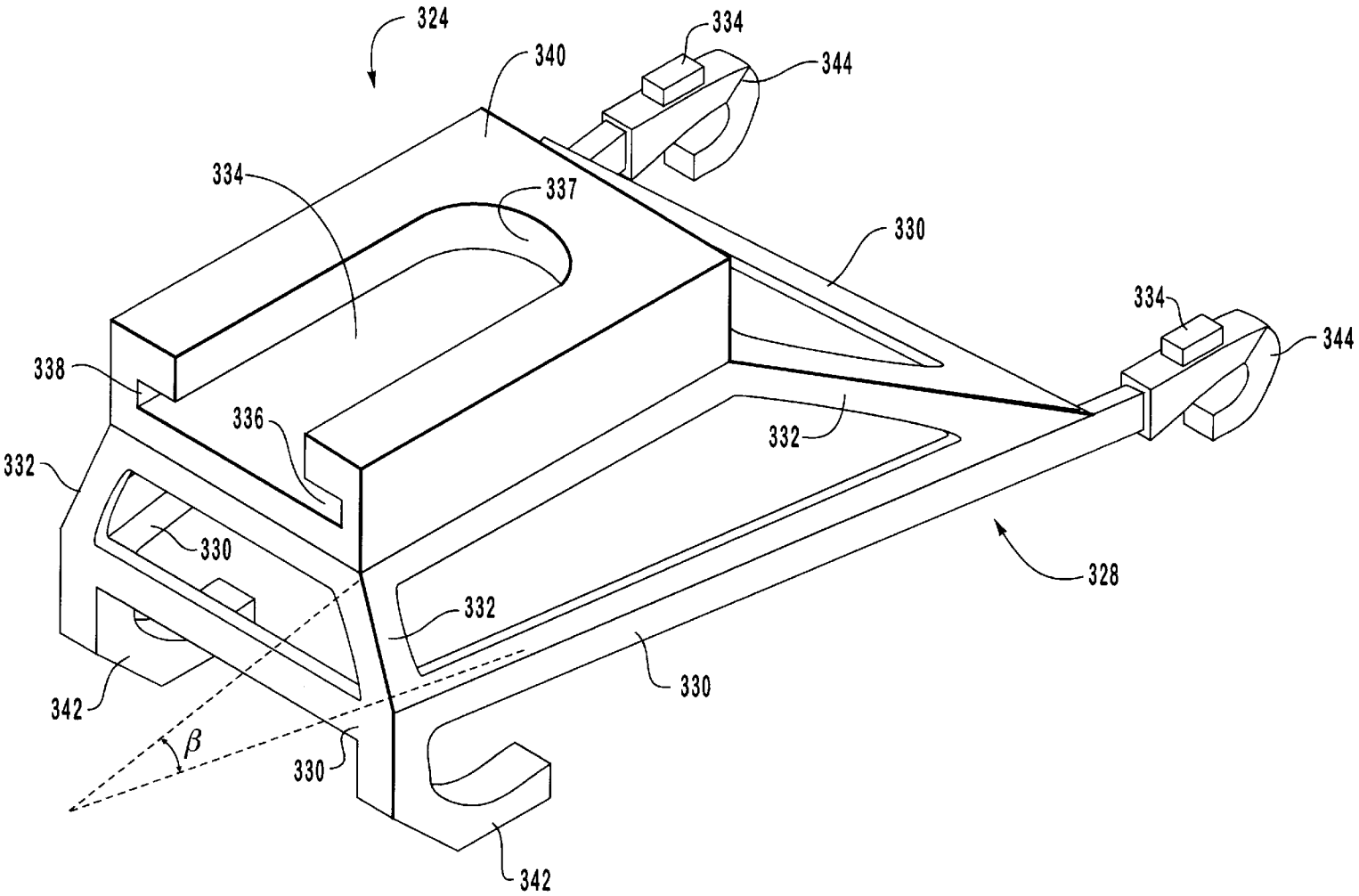
FIG. 21 is a perspective view of an attachment frame for releasably mounting the stabilizer device to the ladder during operational use.

With reference to FIG. 21, a preferred embodiment of the attachment frame 324 is more fully described in detail. The attachment frame has a plurality of rung hooks for attaching the frame to the ladder. The rung hooks are divided between a set of top rung hooks 342 and a set of bottom rung hooks 344 for preferably mating with the top rung of the ladder and the third rung from the top, respectively. The top and bottom is simply a reference to the general orientation of the attachment frame against the ladder as the ladder is positioned against a surface during use and should not be construed as limiting. Since the bottom hooks 344 are curved generally upward during use, a release button 334 is provided to allow the bottom hooks 344 to slide downward to clear the third rung and then slid back up into position once the rung is cleared. Release button 334 may alternatively be configured to allow the bottom hooks 344 to pivotally extend straightward during connection and then ratchet back closed about the third rung by pushing. Although the rung hooks are depicted as having two top and bottom hooks, the rung hooks may alternatively be configured as a singular hook on the top and bottom or as more than two hooks. The top and bottom rung hooks are attached near the comers of a quadrilateral frame 328 which is comprised of four metal braces 330. Together, the four metal braces form a plane 331 which, during use, substantially parallels the plane formed by the rungs of the ladder. Angularly offset from the plane 331, by means of four variously sized offset braces 332, is a sliding channel 334 for releasably mounting differing stabilizer devices to the attachment frame.

The sliding channel 334 is configured generally with a first cross section 336 along the length of the sliding channel. At one end thereof 338 is an opening for mateably receiving a second cross section that is attached to the stabilizer device. At the other end thereof 340 is a closure for abutingly mating with the second cross section. The second cross section, described later, is similar in shape but slightly smaller than the first cross section to enable a sliding fit between the stabilizer device and the attachment frame. In this embodiment, the shape of the first cross section is substantially a rectangle. Additionally, along a central portion of the sliding channel is an opening 337 generally formed as a "U" shape to allow the stabilizer device to be positioned against various surfaces without interference from the attachment frame.

In use, the mounting of the stabilizer device to the attachment frame is accomplished by mating the second cross section on the stabilizer device with the first cross section at the opening of the one end 338 and sliding the second cross section through the sliding channel 334 until the second cross section is abutted against the closure of the second end 340. Since the attachment frame is oriented with the opening of the sliding channel towards the top of the attachment frame and the closure towards the bottom, the second cross section is held abutted against the closed second end by gravity.

Facilitating this gravity abutment is the angular offset, angle $\beta$, of the sliding channel. Because the attachment of the top and bottom rung hooks to the top and third rungs of the ladder causes the plane 331 formed by the quadrilateral frame to substantially parallel the ladder, the attachment frame 324 is correspondingly caused to be oriented towards the curved pole surface by ladder angle, $\alpha$. Therefore, it should be appreciated that since the sliding channel is angularly offset from the plane 331, the sliding channel is advantageously positioned in a substantially parallel arrangement with the vertical plane of the curved surface facing the ladder. In other words, the sliding channel is substantially parallel with the pole. This allows the second cross section of the stabilizer device to abut against the closed second end of the sliding channel directly in-line with the force of gravity unlike that which would exist if the sliding channel was parallel with the ladder and not angularly offset. The angular offset, $\beta$, in this embodiment is about 15° to cooperate with a ladder angle, $\alpha$, of about 850. It should be appreciated, however, that the angular offset of the attachment frame could also be configured as a different angle and could be mechanically adjustable between these and other angles.

Figure 22:
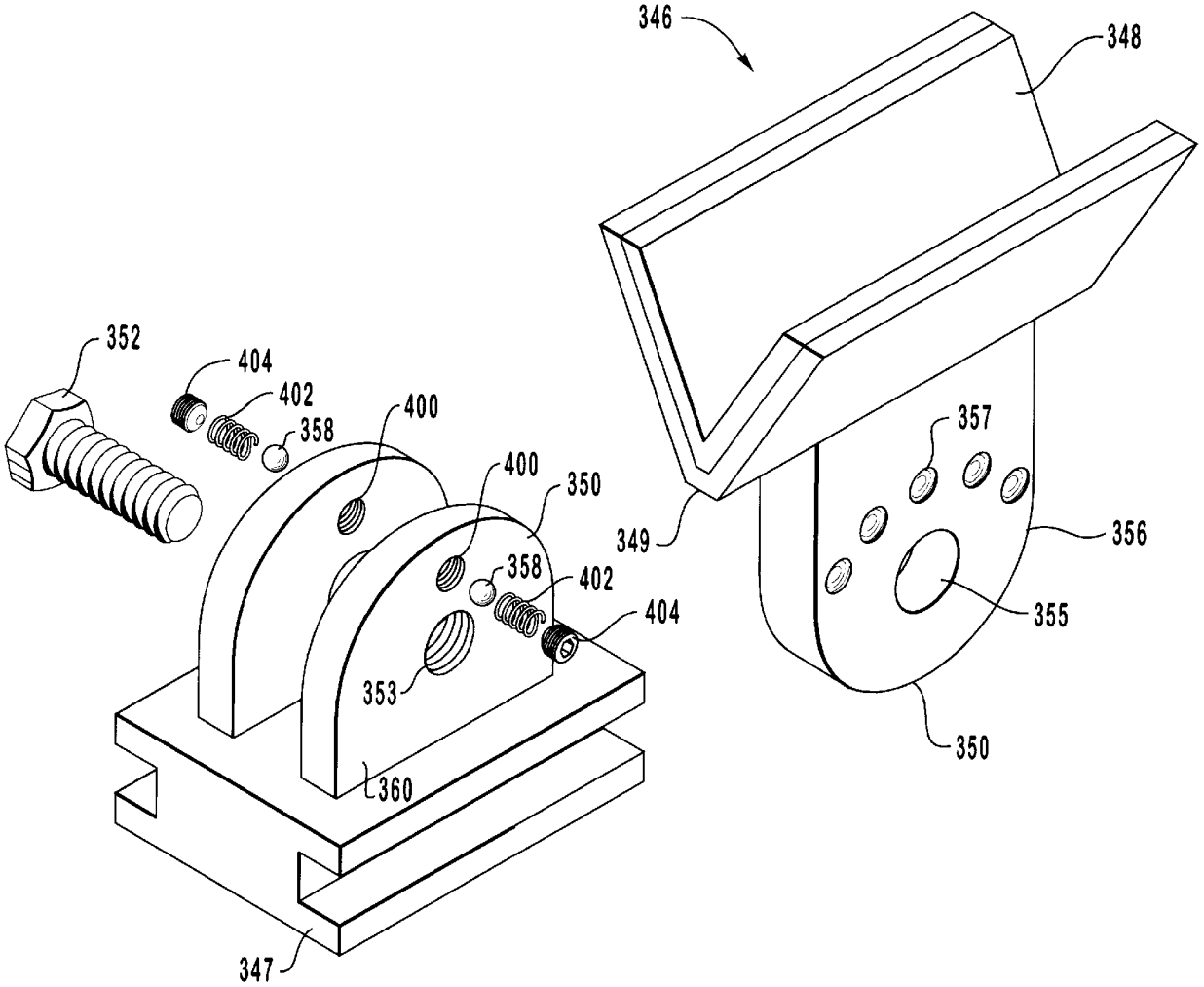
FIG. 22 is a perspective view of a corner bracket stabilizer device for facilitating ladder stability against a cornered surface during operational use.

With reference to FIG. 22, a comer bracket stabilizer device particularly useful for stabilizing a ladder against a cornered surface such as a building comer or an apse is depicted generally as 346. In this embodiment, the comer bracket stabilizer device is releasably mateable with the attachment frame 324 of FIG. 21. The mating occurs, as previously described, by slidingly mating the second cross section 347 of the comer bracket with the first cross section 336 of the sliding channel 334. The opening 337 of the sliding channel facilitates all remaining portions of the comer bracket stabilizer device that are substantially in a direction away from the second cross section.

Extending in a direction away from the second cross section is a pair of rotatably mountable hubs 350, joined together by pin 352 through holes 353 and 355, and a set of adjustable pads 348 mounted thereto. The adjustable pads facilitate attachment of the comer bracket to varying degrees of angularly shaped cornered surfaces by angularly varying about pivot point 349. In this manner, the pads receive and substantially conform against the cornered surface. The pads are preferably adjustable between 0° and 180°0 with a most preferred angle of about 90°. The adjustable pads, however, may also be adjusted beyond 180° for cornered surfaces that are generally recessed within a building, for example.

The pair of rotatably mountable hubs 350 allows a means for angularly refining the adjustment between the pads and the cornered surface when, for example, the sliding channel of the attachment frame is not in a substantially parallel arrangement with the vertical plane formed by the cornered surface (not shown). Refined adjustments are accomplished by the arrangement of two detents 357, one per each side of one of the hubs 356, matingly engaged by ball bearings 358 that are biased towards the detents. The ball bearings which are attached on the other hub thereof 360 are biased through hole 400 by means of spring 402 and spring cap 404. The ball bearings are biased far enough into the detents 357 to hold the one hub 356 in a first position. By forcing the hubs to rotate, by grasping and pushing the adjustable pads, for example, a user can overcome the bias and allow another detent to be engaged by the ball bearings which, correspondingly, allows the adjustable pads to be adjusted into a second position. Since adjacent detents are positioned closely together, the adjustments between the first and second positions are small which accounts for the refined adjustments between the corner bracket and the cornered surface. Other alternatives for effectuating the refined adjustments include a singular ball bearing biased into a singular detent on only one side of the one hub, a cotter pin/hole arrangement or any other similar means.

Figure 23:
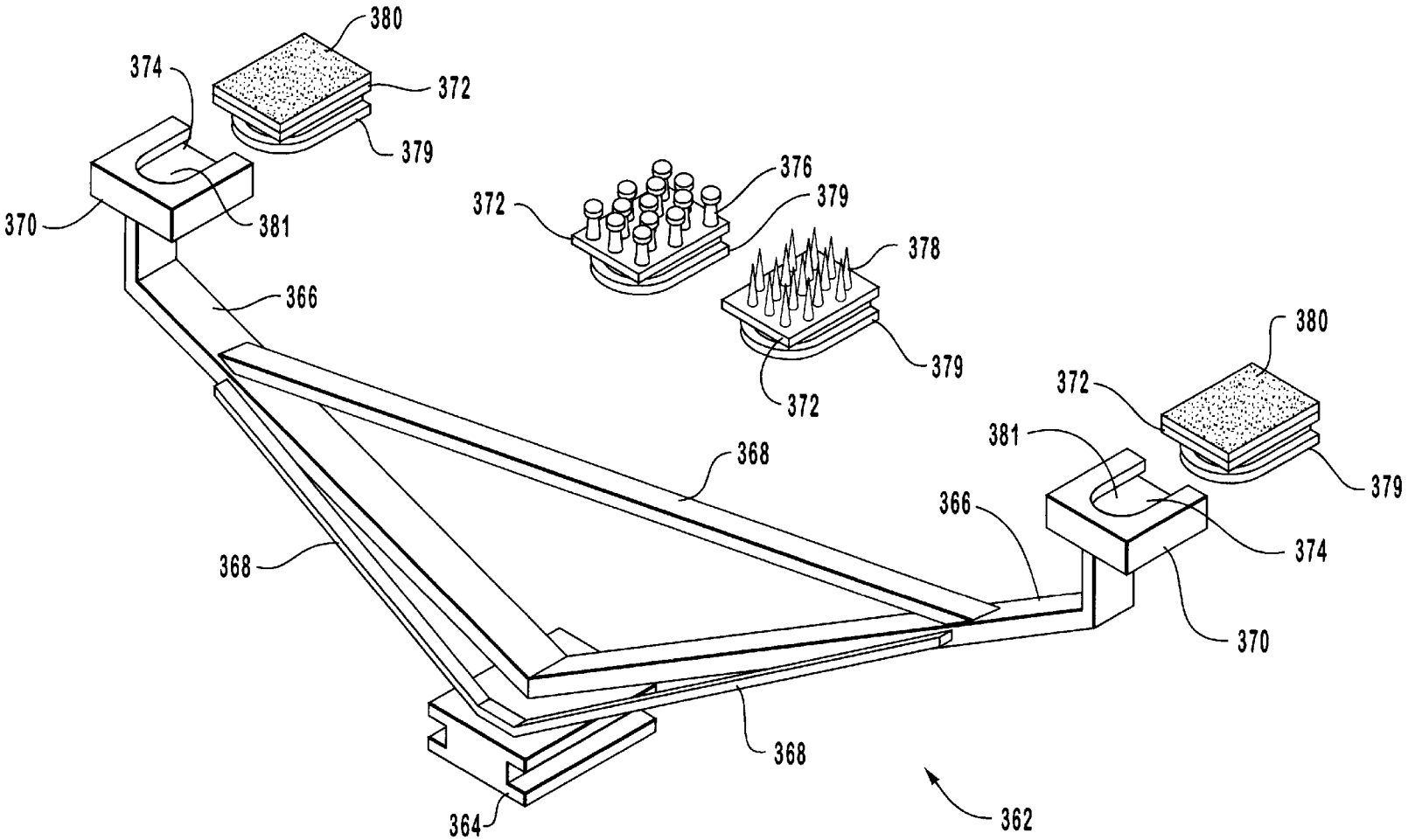
FIG. 23 is a perspective view of a standoff attachment stabilizer device releasably matable with a plurality of auxiliary surface attachments for facilitating ladder stability at a distance away from a surface during operational use.

With reference to FIG. 23, a standoff attachment stabilizer device useful for stabilizing a ladder at a distance away from a surface is depicted generally as 362. A standoff attachment 362 finds particular application in stabilizing a ladder over an opening where no surface exists or in preserving an underlying surface from damage when the surface is fragile, such as a marble, tile, precious metal, ceramic or a painting surface, and would be destroyed if the ladder were leaned there against. In this embodiment, the standoff attachment stabilizer device is releasably mateable with the attachment frame 324 of FIG. 21. The mating occurs, as previously described, by slidingly mating the second cross section 364 of the standoff attachment with the first cross section 336 of the sliding channel 334. The opening 337 of the sliding channel facilitates all remaining portions of the standoff attachment stabilizer device that are substantially in a direction away from the second cross section.

Extending in a direction away from the second cross section is a pair of spaced apart arms 366 separated and balanced by a plurality of stabilizer bars 368. The pair of arms are of suitable size and strength formed of any material, such as aluminum, steel, or other metals to prevent a top of the ladder from contacting the surface. In this manner, only the pair of arms contacts the underlying surface so that the ladder cannot damage that surface, for example. At the end of each arm is a foot 370 for receiving and releasably mating with a plurality of auxiliary surface attachments 372. The foot releasably mates with the auxiliary surface attachments by means of a sliding channel 374 similar to the sliding channel of the attachment frame previously described. The auxiliary surface attachments are preferably arranged as grass cleats 376, ice spikes 378 and cushion pads 380 and have the second cross section 379 attached thereon for slidingly mating with the first cross section 381 of the sliding channel 374.

It should be appreciated that although the auxiliary surface attachments 372 are herein described as releasably mateable with the standoff attachment, they are equally useful in stabilizing the ladder against various ground surfaces. In a preferred embodiment the auxiliary surface attachments 372 are also releasably attachable as rail shoes for the various rail sections of the ladder. With reference to FIG. 15B, an alternate embodiment of the rails shoes comprises replacing clevis section 290 with the sliding channel 374 of the standoff attachment to which auxiliary surface attachments are releasably attachable thereto. It is also contemplated that the auxiliary surface attachments in the form of rail shoes are rotatingly adjustable to allow for various relief of the ground surface, such as an incline.

Figure 25:
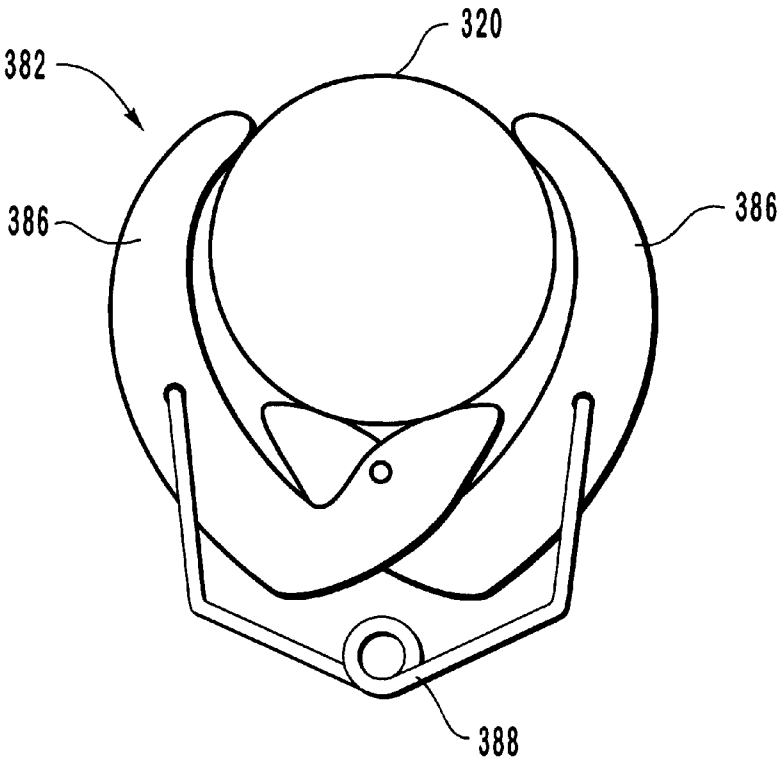
FIG. 25 is a top view of a caliper stabilizer device in the closed position for facilitating ladder stability against a curved surface during operational use.
Figure 24:
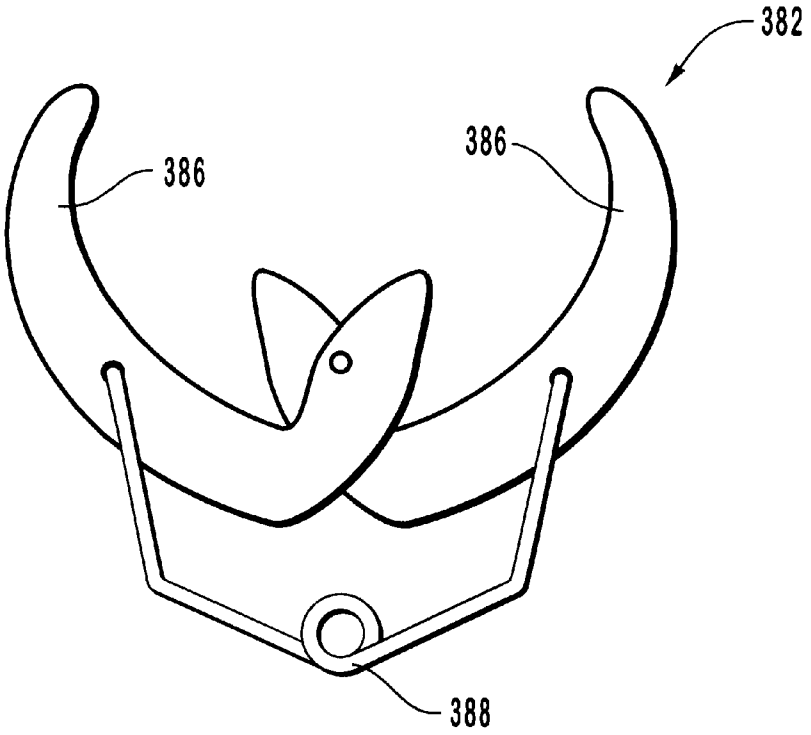
FIG. 24 is a top view of a caliper stabilizer device in the open position for facilitating ladder stability against a curved surface during operational use.

With reference to FIG. 24, a tree or pole caliper stabilizer device particularly useful for stabilizing a ladder against a curved surface, as in FIG. 20, is depicted generally as 382. In this embodiment, the caliper stabilizer device is releasably mateable with the attachment frame 324 of FIG. 21, as previously described, by slidingly mating the second cross section of the caliper (not shown) with the first cross section 336 of the sliding channel 334. The caliper 382 comprises of a set of interlockingjaws 386 pivotable between an open and a closed position. The open position, as depicted in FIG. 24, is for substantially enveloping the curved surface whereas the closed position, as depicted in FIG. 25, is for securely fastening the set ofjaws about the curved surface 320. Preventing the jaws from inadvertently opening from the curved surface during operational use is a bias means 388 in the form of the well known looped rigid wire.

Figure 26:
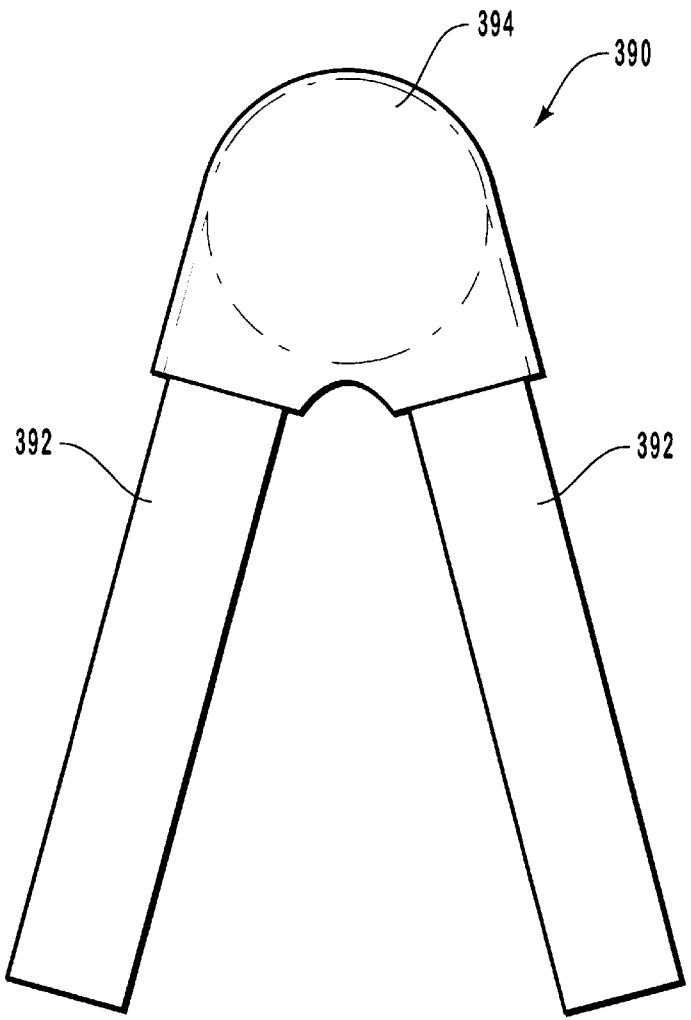
FIG. 26 is a side view of a tressel adapter for converting a ladder into a tressel support.

With reference to FIG. 26, an adapter generally as 390 is depicted for converting a ladder into a trestle for affording support for a variety of work loads such as lumber or bricks. The adapter 390 has a pair of legs 392 angularly joined together at an apex 394 to form a generally caret shaped apparatus. Each leg has a cross section substantially similar in shape but smaller than a cross section of a rail section of a ladder (not shown). In this manner, the pair of legs of the adapter are insertable into two corresponding rail cross sections to allow a work load to be positioned across the apex 394. It should be appreciated that a singular leg may be insertable into a singular rail cross section depending upon the particular arrangement of trestle support that is desired. Typically, the cross section is a rectangular shape and each leg is angularly about 30° from the other leg. The apex is preferably moldable plastic to facilitate aesthetics but may equally be any arrangement suitable for joining the legs and supporting a work load.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by a United States Letters Patent is:

1. A remotely lockable hinge, comprising:

a) a first extended portion;

b) a second extended portion rotatably connected to said first extended portion so that said first and second extended portions are retained in close proximity to each other yet are free to rotate relative to each other;

c) indexing means for preventing relative motion between said first and second extended portions, wherein said first extended portion and second extended portions each have a plurality of indexing holes formed therethrough and wherein said indexing means for preventing relative motion between said first and second extended portions comprises:

i) a plurality of indexing pins capable of extending through said indexing holes formed through said first and second extended portions; and ii) means for retracting said indexing pins simultaneously from said indexing holes so that said first and second portions are free to rotate relative to each other; and d) means for remotely operating said indexing means, the means for remotely operating said indexing means comprising:

(1) a wire coupled to the means for retracting said indexing pins such that movement of the wire moves the indexing pins in a direction transverse to the direction of movement of the wire and thereby retracts said indexing pins from said indexing holes; and (2) a pulley coupled to one of the first and second extended portions, wherein the wire passes over the pulley, said means for retracting said indexing pins from said indexing holes comprises a separator plate coupled to the indexing pins and a separator rod coupled to the separator plate, such that by said movement of the wire a force is applied to the separator rod retracting the indexing pins.

2. A remotely lockable hinge according to claim 1, further comprising a taper slide movably coupled to the separator rod such that movement of the taper slide retracts the indexing pins.

3. A remotely lockable hinge according to claim 1, wherein the means for remotely operating said indexing means comprises a remote actuator bar coupled at one end thereof to the means for retracting said indexing pins.

4. A remotely lockable hinge according to claim 3, wherein the means for remotely operating said indexing means further comprises a remote actuator configured to be coupled to an opposing end of the remote actuator bar.

5. A remotely lockable hinge according to claim 4, wherein the remote actuator is configured to selectively move the remote actuator bar, thereby unlocking the hinge.

6. A remotely lockable hinge according to claim 5, wherein the remote actuator comprises a remote actuator shaft which is configured to selectively move in an inward direction so as to engage the remote actuator bar, and then to selectively move in a downward direction to impart a downward motion to the remote actuator bar, thereby unlocking the hinge.

7. A remotely lockable hinge according to claim 1, wherein the remote actuator bar is configured to slide with respect to the first and second extended portions.

* * * * *

UNITED STATES PATENT AND TRADEMARK OFFICE

CERTIFICATE OF CORRECTION

PATENT NO. : 5,954,157

DATED : Sep. 21, 1999

INVENTOR(S) : Ronald R. Grimes; Jefferson B. Hunt, both of Provo, Utah

It is certified that error appears in the above-identified patent and that said Letters Patent is hereby corrected as shown below:

Title Page, Assignee Heading, "Salt Lake City, Utah" should be – Provo, Utah –
Column 8, Line 42, unbold "49"
Column 18, Line 31, after "through" delete "the"
Column 18, Line 34, before "plate" delete "the"
Column 18, Line 36, delete "the"
Column 18, Line 37, delete "the"
Column 18, Line 38, delete "the"
Column 22, Line 63, "Rail shoes..." should begin a new paragraph
Column 23, Line 43, "a" should be -- α --
Column 24, Line 65, "850" should be – 85° –
Column 25, Line 3, "comer" should be – corner –
Column 25, Line 5, "comer" should be – corner –
Column 25, Line 6, "comer" should be – corner –
Column 25, Line 10, "comer" should be – corner –
Column 25, Line 13, "comer" should be – corner –
Column 25, Line 17, "comer" should be – corner –
Column 25, Line 22, replace "180°0" with – 180° –
Column 26, Line 40, replace "interlockingjaws" with – interlocking jaws –
Column 26, Line 44, replace "ofjaws" with – of jaws –

Signed and Sealed this

Thirtieth Day of May, 2000

Attest:

Q. TODD DICKINSON

Attesting Officer

Director of Patents and Trademarks